US005113736A

United States Patent [19]

Meyerle

[11] Patent Number: 5,113,736

[45] Date of Patent: May 19, 1992

[54] ELECTROMAGNETICALLY DRIVEN PUNCH PRESS WITH MAGNETICALLY ISOLATED REMOVABLE ELECTROMAGNETIC THRUST MOTOR

[76] Inventor: George M. Meyerle, 17 Lakeview Dr., Brookfield, Conn. 06804

[21] Appl. No.: 544,123

[22] Filed: Jun. 26, 1990

[51] Int. Cl.[5] ..... B26D 5/08

[52] U.S. Cl. ..... 83/575; 83/529; 83/530; 72/430; 100/917

[58] Field of Search ..... 83/529, 530, 575, 576, 83/577; 72/430, 707, 54; 100/257, 917

[56] References Cited

U.S. PATENT DOCUMENTS

| | | | |
|---|---|---|---|
| 3,695,130 | 10/1972 | Fedrigo | 83/575 X |
| 3,709,083 | 1/1973 | Doherty | 83/575 |
| 4,022,090 | 5/1977 | Doherty et al. | 83/577 X |
| 4,056,029 | 11/1977 | Doherty et al. | 83/575 |

*Primary Examiner*—Frank T. Yost
*Assistant Examiner*—Eugenia A. Jones
*Attorney, Agent, or Firm*—Parmelee, Bollinger & Bramblett

[57] ABSTRACT

An electromagnetically-driven punch press has an electromagnetic drive thrust motor comprising a fan-cooled solenoid winding and movable armature mounted in elevated location for isolating the magnetic circuit from the tooling to avoid tool magnetization and isolating winding heat from tooling for stabilizing tool dimensions. Stroke length, "open" height and "shut" height are conveniently adjustable; and tool performance is optimized by adjusting armature-thrust versus travel. Four-way access to tooling enables convenient material feeding and handling, including multi-direction or multi-layer feed. Scrap pieces are freely downwardly ejected. Multiple electromagnetic drives are mountable side-by-side at the same elevation, or they are stackable at multiple levels for increased power or for tailoring force-versus-distance relative to materials being worked. Materials-handling and/or tool-handling robots or pneumatic actuators can be installed on an elevated platform. The electromagnetic drive is removable and interchangeable among multiple die sets for easy tooling change-over among various production runs. Thus, "tooling set-up" by skilled machinist need be performed only once for each die set until worn dies require sharpening. A resilient upwardly biased shuttle pole-piece boosts available energy by extending upwardly into the winding opening. Ball-bearing bushings carry the movable tool and anti-skid supports prevent ball bearings and their cages from skidding downwardly when the moving tool impacts against the work material. Adjustable resilient cushioning arrests tool travel for minimizing "tool whip" and tool wear at the end of the work stroke.

53 Claims, 10 Drawing Sheets

1/8" THK & 3/8" THK SPACER (NON-MAGNETIC STAINLESS STEEL) PLACED UNDER ARMATURE
1/4" THK SPACER (NON-MAGNETIC STAINLESS STEEL) PLACED UNDER ARMATURE
3.50
3.00
0.750 STROKE
1.250 STROKE

ARMATURE SPACER CHART
STROKE SETTING
SPACERS NEEDED
0.125
0.250
0.375
1.38 TO 1.50
1.26 TO 1.37
1.01 TO 1.25
0.76 TO 1.00
0.51 TO 0.75
0.26 TO 0.50
0.00 TO 0.25
STROKE ADJUSTING

SHUT
5.50 SHUT HEIGHT

OPEN
7.00 MAXIMUM OPEN HEIGHT
SCREW, MTG-TOP PLATE
TOP PLATE
GUIDEPIN
RETAINING RING
BUSHING
MOTION PLATE
RETAINER-BALL BEARING
ADJUSTOR, RETAINER
STOP, URETHANE
BASE PLATE
94
56
59
35
166
168
36
37
33
60
31
120
124
122
128
39
126
38

TOP VIEW - COVER REMOVED

ELECTROMAGNETICALLY DRIVEN PUNCH PRESS WITH MAGNETICALLY ISOLATED REMOVABLE ELECTROMAGNETIC THRUST MOTOR

FIELD OF THE INVENTION

The present invention is in the field of electromagnetically driven punch presses, and more particularly relates to such impact presses having adjustable anti-skid supports for their ball-bearing bushings and relates to electromagnetic drive thrust motors which are magnetically isolated from the punch press tooling and are removable from the die sets for interchanging among several die sets for convenient and easy tooling change-over and which may incorporate or provide some or many of the features outlined below in the SUMMARY.

BACKGROUND

As background for the present invention, reference is invited to four Doherty U.S. Pat. Nos. 3,709,083; 4,022,090; 4,056,029; and 4,135,770, copies of which are being furnished herewith for convenience of examination.

In the punch press shown in Doherty—U.S. Pat. No. 3,709,083 the tooling is in a fringe flux path of the solenoid winding 82, 84 such that the tooling tends to become magnetized. There is no provision for direct cooling of the electromagnet. There is no provision shown for adjustment of stroke length.

In the punch press disclosed in Doherty—U.S. Pat. No. 4,022,090, the solenoid winding is located in the base of the machine sandwiched between a base plate and a connecting plate causing the winding to be subject to overheating and being without cooling. The base location of the bulky winding interferes with handling of materials, interferes with exit of scrap pieces, makes for inconvenient tooling set-up, and causes difficulty in adjustments of open and shut height and stroke length. In the Doherty punch press shown in the '090 patent, the tooling and guide pins and their bushings are all located in a significant fringe flux path of the solenoid winding causing them all to become magnetized. Such magnetization of tooling, guide pins and bushings causes steel shavings, filings, burr pieces and flakes and similar scraps of steel to become attracted to and to collect on these magnetized parts, leading to their rapid deterioration or actual sudden destruction. When a steel scrap of significant size becomes adhered to one side of a male or female die overlying a cutting edge, subsequent closure of the dies produces a sudden, eccentric, off-axis obstruction deflecting the male die and causing it to smash into an incorrect region of the female die with consequent destruction of the dies. Steel particles adhering to the guide pins become abrasive intrusions wedging between the moving parts and quickly wearing and soon destroying them.

In the punch press described in Doherty—U.S. Pat. No. 4,056,029, the solenoid winding is located in a movable housing which is secured to a movable tool holder. The winding together with its electrical connections moves during each stroke. Thus, the winding and its connections are subjected to a severe beating due to repeated frequent mechanical shocks of tool impact against work material. Such repeated mechanical impact stressing of the winding and its electrical connections tends to cause early electrical failure with relatively short reliable operating life. It is noted that in FIGS. 2 and 4 the moving bushings 26 bottom on stops 86 (col. 5, line 16).

Doherty U.S. Pat. No. 4,135,770 is a Division of U.S. Pat. No. 4,056,029, and is directed to a leader pin for a punch press die set having a bore in the leader pin containing an elongated axially movable button and a spring urging this movable button toward its extended position. This button is pushed inwardly during each power stroke and springs back to its extended position for pushing the movable portion of the die set back to its initial position. This complex leader pin serves as a stationary armature in cooperation with a movable solenoid winding having a movable housing as discussed above regarding the '029 patent.

In the '029 and '770 patents moving non-ball-bearing bushings 26 (FIGS. 2 and 4; often called "sleeve bushings") are shown bottoming on stops 86. During recent years ball-bearing bushings (often called "linear bearings") have been used instead of sleeve bushings in many instances in punch presses for reducing friction during the power and return strokes. The balls in such linear bearings are mounted in a cage (also called a "retainer") within a housing, and it is the housing of the linear bearing which bottoms against such stops. A problem caused by such substitution of linear bearings for sleeve bushings is the consequent downward skidding of the cage and balls, caused by their own downward momentum thereby causing rubbing wear on the guide pin during each downward stroke and return stroke with consequent rapid deterioration of the balls and cage in the linear bearing. In other words, each time the bearing housing bottoms down against the stop, the housing suddenly stops its rapid downward motion, but the cage and balls have significant downward momentum and tend to skid down. During the subsequent upstroke, the misplaced balls cannot roll freely due to the conventional retainer, and so they skid up against the guide pin with consequent undue wear of the guide pin and rapid deterioration of the components in the linear bearing.

SUMMARY

An electromagnetically-driven punch press embodying the present invention has an electromagnetic drive thrust motor comprising a solenoid winding and movable armature in an elevated location above the die set. The solenoid winding is mounted within a fan-cooled ferromagnetic housing secured to the top of a stationary ferromagnetic top plate arranged for isolating the magnetic circuit from the die set and tooling so as to avoid magnetization of the tooling, and isolating electrical heating of the winding from the tooling for stabilizing dimensions of the tooling.

By virtue of their elevated location, the winding and armature are readily accessible for convenient cooling by a fan. Moreover, since the stationary top plate is mounted to the top ends of vertical guide pins and since the electromagnetic drive thrust motor is mounted above this stationary top plate, the motor is stationary and is out of the way, and this arrangement thereby provides for convenient adjustment of: stroke length, "open" height and "shut" height.

Further, a punch press embodying this invention provides for easy adjustment of the armature position relative to the tooling stroke for optimizing the armature-thrust-versus-travel characteristics relative to the required stroke and open/shut heights for maximizing tool performance and for maximizing efficient utilization of electrical power. There is access to the tooling from front, back, left and right, i.e. four-way access to the tooling is available for convenience in material feeding and handling, thereby enabling multi-direction or multi-layer material feed, if desired. Also, the bottom of the punch-press is freely available for convenient downward ejection of "scrap pieces".

The elevated stationary ferromagnetic top plate enables multiple electromagnetic drive motors to be mounted side-by-side at the same elevated location for obtaining increased power during the work stroke, if desired, or for tailoring force-versus-distance characteristics of the work stroke for optimizing performance of tooling relative to material being worked. Also, this top plate configuration enables multiple electromagnetic drive motors to be stacked at multiple elevational levels one-above-another in staggered relationship for providing increased power during the work stroke, if desired, or for tailoring force-versus-distance characteristics of the work stroke for optimizing performance of the tooling.

The top plate structure also provides an elevated platform location where material-handling and/or tool-handling robots or pneumatic actuators can be installed.

Associated with the ferromagnetic top plate and with the opening in the solenoid winding, there is a shuttle pole-piece projecting upwardly into the winding opening for boosting available energy and magnetic force. This shuttle pole-piece is movably mounted with a resilient upward bias for permitting the shuttle pole-piece to move downwardly for reducing impact shock, noise and vibration upon being struck by the downwardly-moving armature upon completion of its work stroke.

In order to prevent downward dislodgement of the cage and balls in the linear bearings (ball-bearing bushings), there are anti-skid supports. Adjustable resilient cushioning arrests tool travel for minimizing "tool whip" and for minimizing tool wear occurring in the prior art near the end of each work stroke due to misalignment caused by such tool whip.

BRIEF DESCRIPTION OF THE DRAWINGS

The various additional features, aspects, advantages and objects of the present invention will become more fully understood from a consideration of the following detailed description of presently preferred embodiments, together with the accompanying drawings, which are not drawn to scale but rather are arranged for clarity of illustration and explanation. In these drawings:

FIG. 7 is an elevational sectional view taken along the line 7—7 in FIG. 4.

FIG. 8 is an elevational sectional view taken along the line 8—8 in FIG. 7.

DETAILED DESCRIPTION OF PREFERRED EMBODIMENTS

Figure 1:
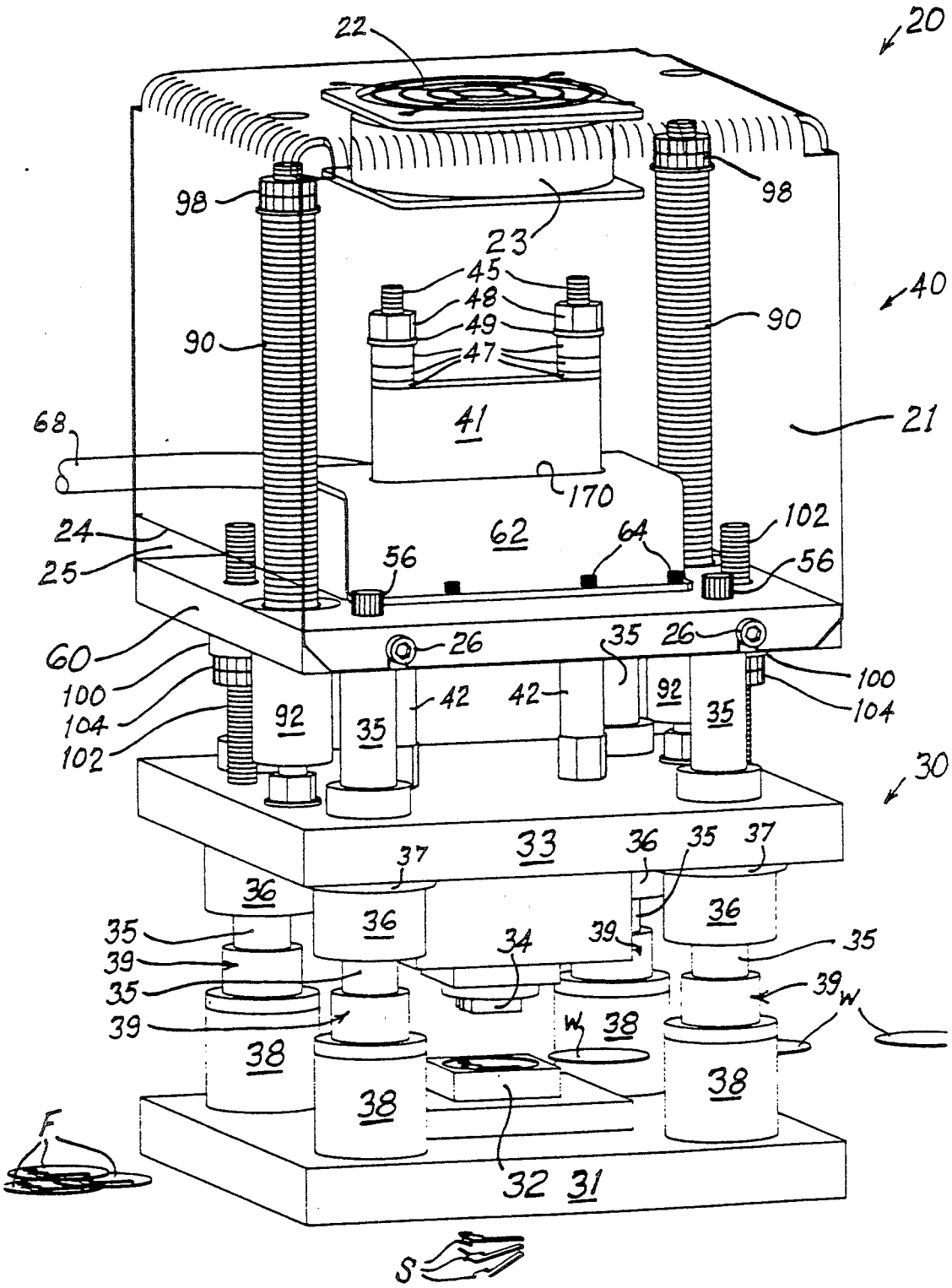
FIG. 1 is a perspective view of a punch press embodying the present invention.

In FIG. 1 is shown a punch press 20 including a die set 30 and an electromagnetic thrust motor 40 for driving the die set in a powerful stroke from an "open" position to a "shut" position. A removable housing 21 of the thrust motor 40 is drawn with a transparent appearance for clarity of illustration. This housing 21 includes an air intake grille 22 having a pancake-type fan 23 mounted below this intake port for blowing cooling air downwardly onto electromagnetic components of the motor 40 to be described later. To provide for exit of the cooling air, sidewalls of the housing 21 terminate at a bottom lip 24 forming outlet ports 25 (only one is seen) at the bottom of this housing. The front and rear walls of this housing are removably attached by cap screws 26 to a stationary top plate or deck 60 to be described in detail later.

The die set 30 comprises a stationary base plate 31 with a female die 32 secured to the base plate and a motion plate 33 carrying a male die 34 aligned with and in opposed relation to the female die 32. Four guide pins (posts) 35 are fixed to and extend vertically from the base plate 31. The motion plate 33 is movably mounted on the four vertical guide pins 35 by respective linear bearings (ball-bearing bushings) 36 which are secured to the motion plate 33 and travel down and up with it. The motion plate 33 seats down upon an annular shoulder 37 which encircles each ball-bearing bushing 36. The motion plate 33, male die 34, and ball bearing bushings 36 comprise the main components of the movable portion of the die set 30.

One of the novel aspects of this die set 30 is that the guide pins or posts 35 are considerably longer than usual. These guide pins extend up through the motion plate 33 to an elevation or level located relatively high above the motion plate for supporting a removable top plate (deck) 60 on which is mounted the electromagnetic thrust motor 40. Thus, the tooling 34, 32 is isolated from the magnetic field of the motor 40 for avoiding magnetization of the tooling. Also, any heating of the thrust motor due to electrical resistance and hysteresis losses is isolated from the tooling for minimizing distortion of the dies resulting from thermal expansion.

Work material "W" can be fed into the die set 30 from front, back, left or right. For example, as shown in FIG. 1, the workpieces W are being fed from the right by suitable work material feed means as known in the art, and such feed means do not comprise part of the present invention and are omitted for clarity of illustration. After each workpiece W has been formed by impact action of the dies 32, 34, resulting scrap pieces "S" are ejected downwardly from the female die 32 through a discharge opening (not shown) in the base plate 31. The finished pieces "F" are fed out toward the left.

In order to stop the downward motion of the movable portion of the die set at the downward limit of its work stroke, there are resilient stops 38 which are adjustable in height, as will be explained later. The housings of the ball-bearing bushings 36 abut against these stops 38.

Figures 6A, 6B:
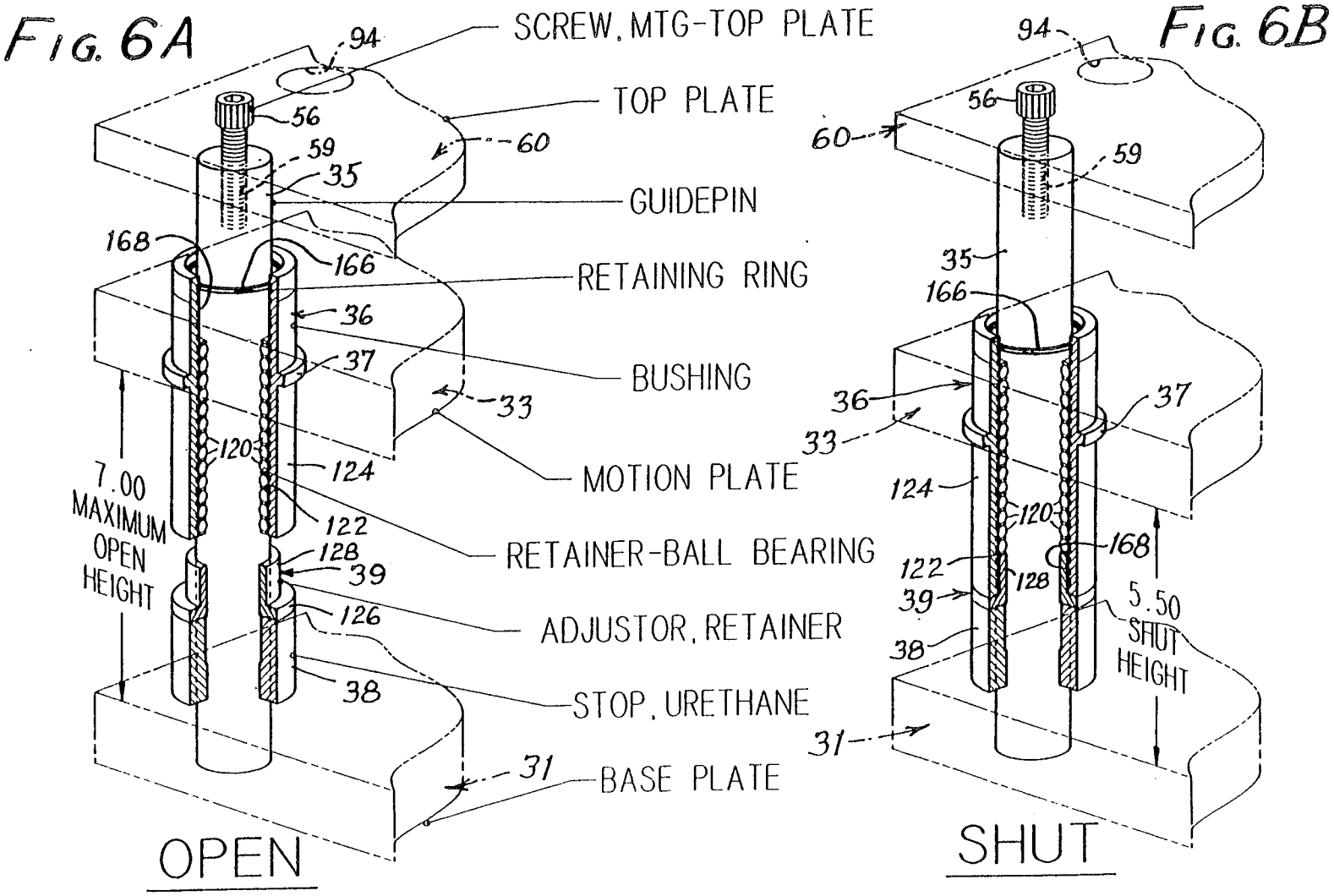
FIGS. 6A and 6B respectively show "open" and "shut" relationships of a linear bearing (ball-bearing bushing) with its adjustable anti-skid stop for preventing downward dislodgement of the ball-cage and ball bearings.

For preventing downward displacement of the ball-bearings and their cage (retainer) which are located within the housing of each bushing 36 (as shown in FIGS. 6A and 6B), there is a novel anti-skid stop 39 of smaller diameter than the main stop 38. Each anti-skid stop 39 extends upwardly coaxial with its associated main stop 38, and is positioned so that this anti-skid stop just "kisses" the bottom of the ball-bearing cage, as shown in FIG. 6B, when the die set has reached the limit of its down stroke, i.e. when the die set is fully "shut". Thus, the cage and balls are prevented from skidding down within the housing of the bushing 36, as will be explained in more detail later.

For driving the motion plate 33 downwardly with rapid acceleration and powerful force, the electromagnetic thrust motor 40 includes a movable armature 41 of ferromagnetic material rigidly connected to the motion plate 33 by a pair of vertical, parallel armature supports 42 of non-magnetic material, for example such as non-magnetic stainless steel, plastic material, ceramic material, or similar relatively rigid non-magnetic structural material, and in a preferred embodiment they are formed of non-magnetic stainless steel. In addition to FIG. 1, attention is now invited also to FIGS. 2, 3 and 4. Each armature support 42 has an axial downwardly projecting threaded stud 43 (FIGS. 3 and 4) of reduced diameter which is received in a threaded socket 44 in the motion plate 33. There is also an axial upwardly projecting stud 45 (FIG. 3) of reduced diameter which extends through a mounting passage 46 near an end of the armature 41.

Figures 5A, 5B, 5C:
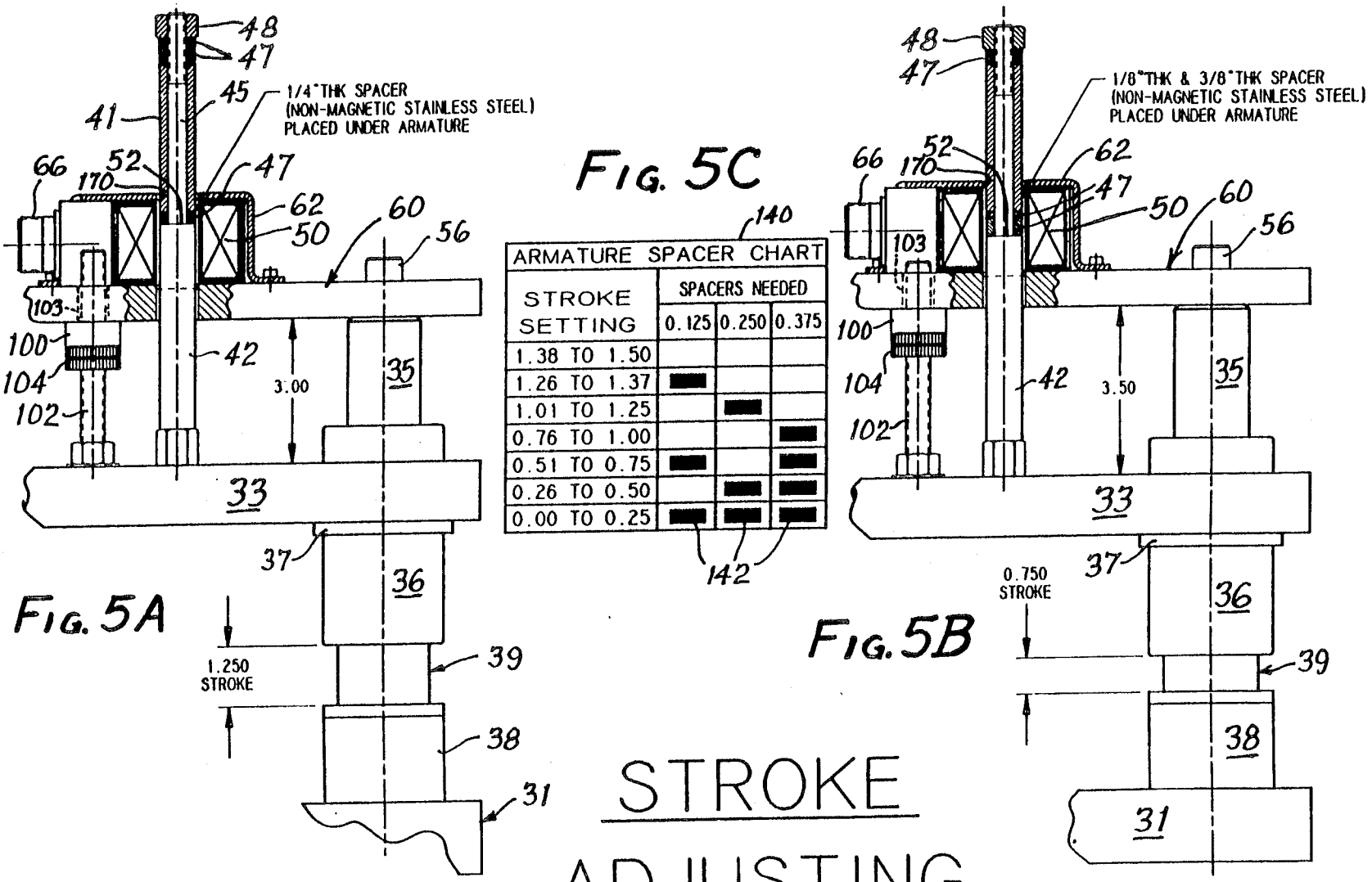
FIGS. 5A and 5B respectively show a longer and a shorter stroke adjustment for explaining operating advantages.
FIG. 5C is an armature spacer arrangement chart showing the method of obtaining stroke length adjustment.

In order to provide for quick and convenient adjustment of the armature elevation above the motion plate 33, i.e. for armature stroke adjustment, there are a plurality of washer-shaped armature spacers 47 (FIGS. 2 and 3) of non-magnetic, relatively rigid structural material such as discussed above for the armature supports 42, and in a preferred embodiment these spacers are formed of non-magnetic stainless steel having various thicknesses. These armature spacers are shown being stored on the upper end of the stud 45. The armature 41 and these spacers 47 are held by a locknut 48 with a washer 49. The nut is threaded onto the upper end of the stud 45. To increase the elevation of the armature 41 above the motion plate 33, the two nuts 48 are removed, the armature 41 is lifted off of its two mounting studs 45, and one or more of these non-magnetic spacers are moved down the stud 45, as shown in FIGS. 5A, B and C, to seat on an armature support shoulder 52 at the lower end of each stud 45. The armature 41 is then remounted on those spacers which have been placed on the shoulders 52 of the two supports 42. The remaining unused spacers 47 are again stored on the studs 45 below the respective locknuts 48.

The electromagnetic thrust motor 40 includes a solenoid winding (FIGS. 3 and 4) also called a "coil" having an opening 54 for accommodating the armature 41 and its two supports 42. This solenoid winding 50 is mounted on a stationary ferromagnetic top plate or deck 60 which is removably mounted on the upper ends of the four guide pins 35, being attached by removable cap screws 56 fitting through holes 58 (FIG. 2) engaging in threaded sockets 59 in the guide pins. A coil enclosure 62 of ferromagnetic material and serving as a magnetic flux director encloses the winding 50 and is secured to the ferromagnetic top plate 60 by screws 64. An electrical connector 66 (FIGS. 2 and 3) for the winding 50 is mounted on the rear of the coil enclosure. An electric power cable 68 (FIG. 1) attaches to this connector 66 for energizing the winding 50 with a pulse of power whenever the thrust motor 40 is operated.

Figure 4:
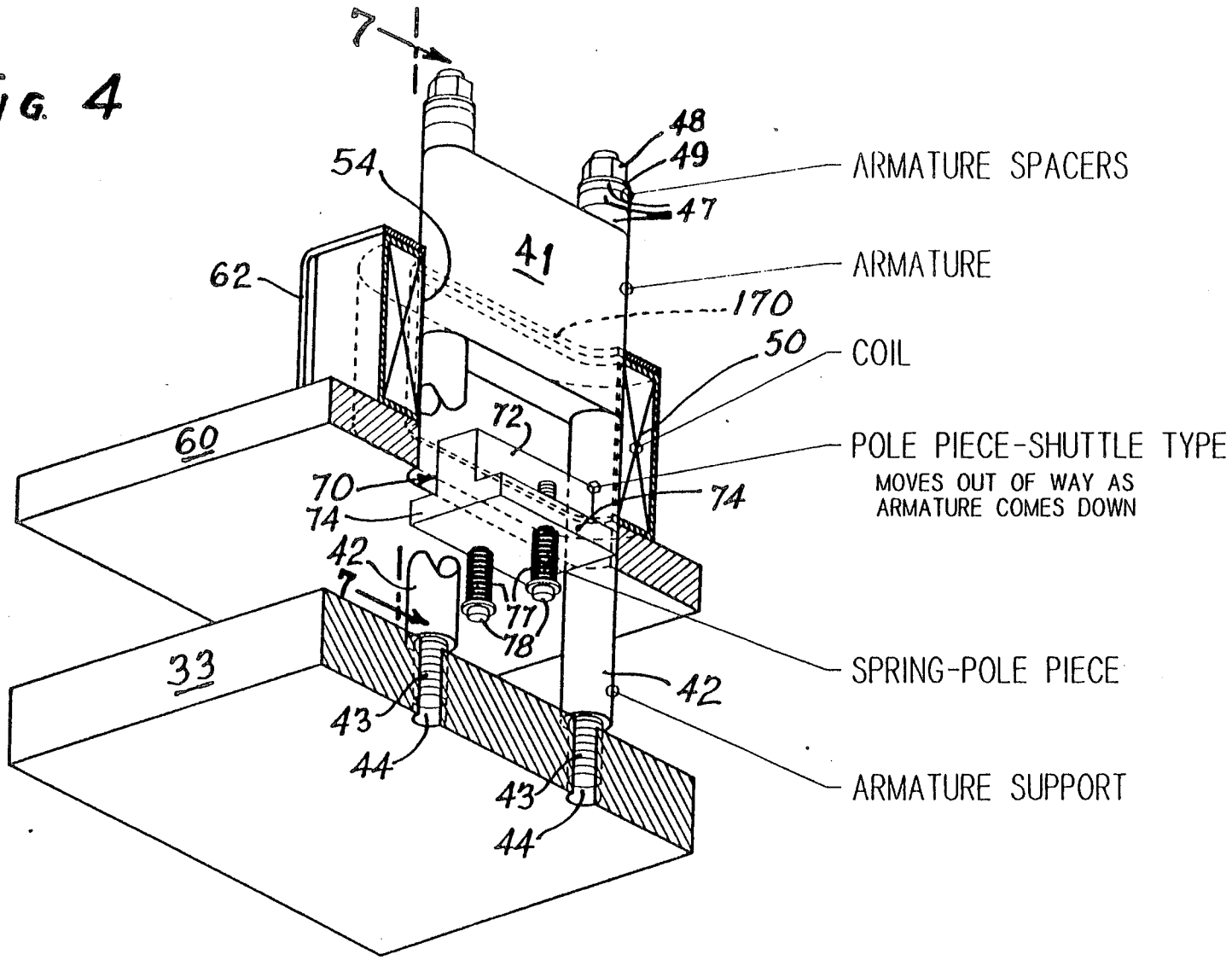
FIG. 4 is a partial perspective and sectional view as seen looking from below for showing a shuttle pole-piece having an inverted T-shape associated with the electromagnetic thrust motor.
Figure 7:
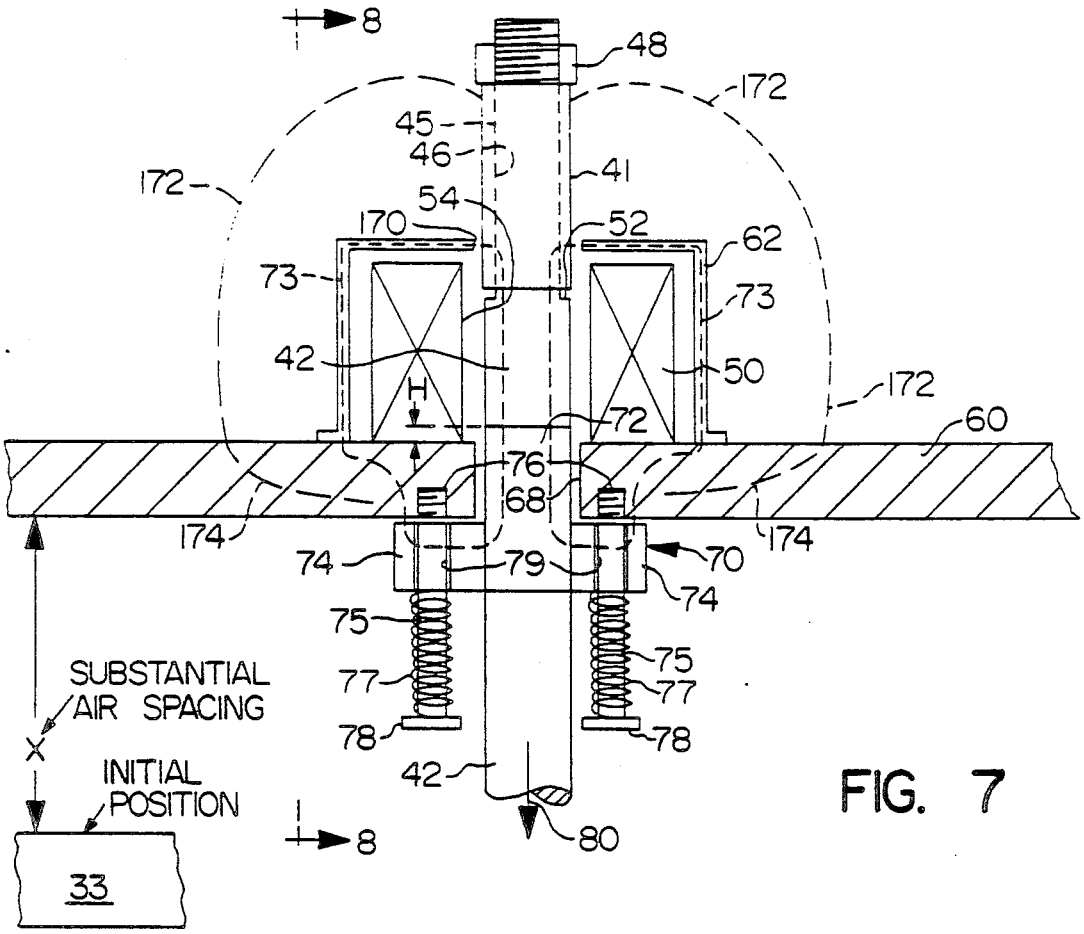
FIG. 7 is a partial elevational sectional view for illustrating features of the shuttle pole-piece and for showing isolation of the magnetic circuit and isolation of electromagnetic heating effects from the tooling.
Figure 8:
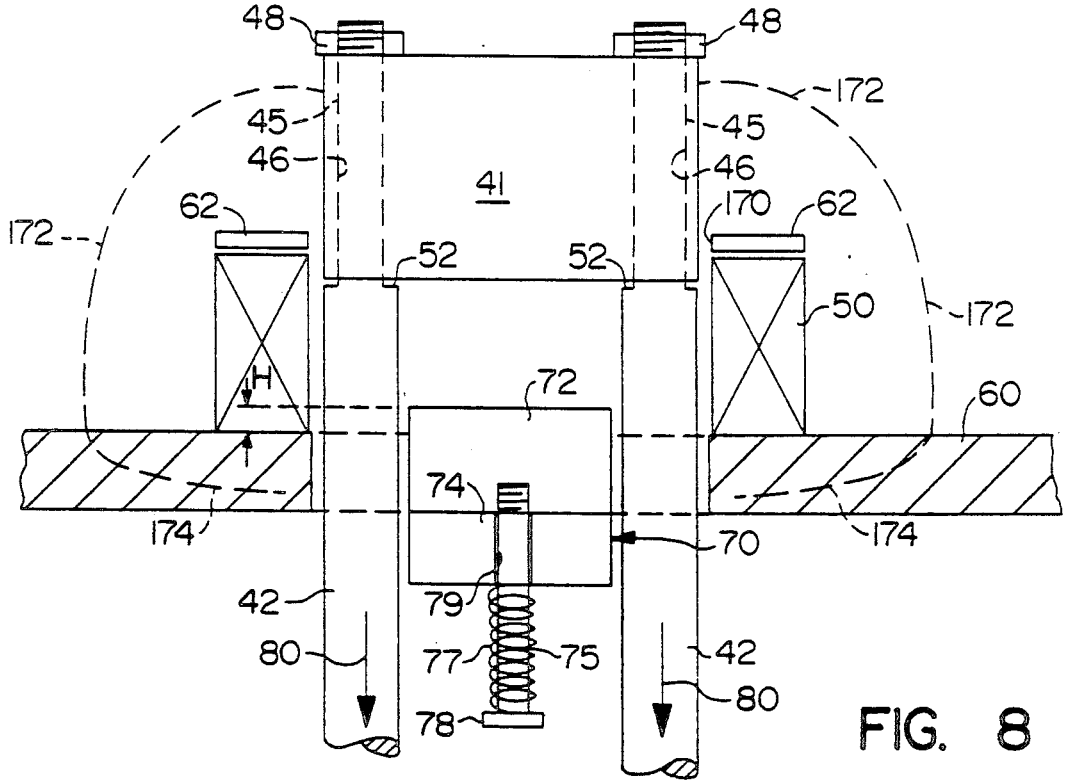
FIG. 8 is a partial elevational sectional view showing the same components as seen in FIG. 7.

With reference to FIGS. 4, 7 and 8, there is shown a shuttle pole-piece 70 of ferromagnetic material for increasing the efficiency and magnetic pull of the armature 41 into the coil 50. This shuttle pole-piece 70 has an inverted T-shape as seen in end elevation in FIG. 7 with a pole 72 which normally projects up into the winding opening 54 to a height "H" above the level of the upper surface of the top plate 60 and with a pair of side flanges 74 which normally rest up against the lower surface of the top plate 60. An opening 68 in this top plate is aligned with the winding opening 54 for accommodating the shuttle pole 72. This pole-piece 70 is vertically slidable along stationary slide rods 75 removably screwed into sockets 76 in the top plate 60. The pole-piece 70 is urged to its upper initial position as seen in FIGS. 7 and 8 by compression springs 77 seated on heads 78 of the vertical slide rods 75. The two parallel slide rods 75 on opposite sides of the pole-piece 70 extend through guide holes 79 in the centers of the respective side flanges 74.

In FIG. 7 the efficient flux paths which are provided by the ferromagnetic enclosure 62, ferromagnetic top plate 60 and ferromagnetic shuttle pole-piece 70 are shown by dashed lines 73. It is noted that these flux paths 73 are relatively far removed and isolated from the tooling. Moreover the armature supports 42 (push rods) are non-magnetic for enhancing the isolation from the tooling and for optimizing the downward thrust of the magnetic field 73 on the ferromagnetic armature 41.

In operation, when the solenoid winding 50 is briefly energized, the armature 41 is powerfully drawn down into the opening 54 until the bottom of the armature hits the pole 72 displacing the pole-piece 70 downwardly and momentarily compressing the springs 77. By virtue of the movable resilient mounting of this shuttle pole-piece 70 for allowing it to move down out of the way, any impact of the armature 41 against the opposed pole 72 is minimized for reducing noise, vibration and wear and tear of components involved and for minimizing tool "whip" that occurs in prior art electromagnetic punch presses when a movable armature impacts against a stationary fixed pole-piece. Such tool whip causes the dies to chatter sideways against each other resulting in unduly rapid rounding of cutting edges and divergent wearing of sidewalls immediately below or above the cutting edges in female and male dies, respectively.

The downward pull on the armature is transferred via the two armature supports (push rods) 42 as a powerful down thrust, indicated by arrows 80 in FIGS. 7 and 8, applied to the motion plate 33 for accelerating the tool die 34 (FIG. 1) downwardly to impact against work material W located between the moving and stationary tooling dies 34 and 32, respectively.

Figure 11:
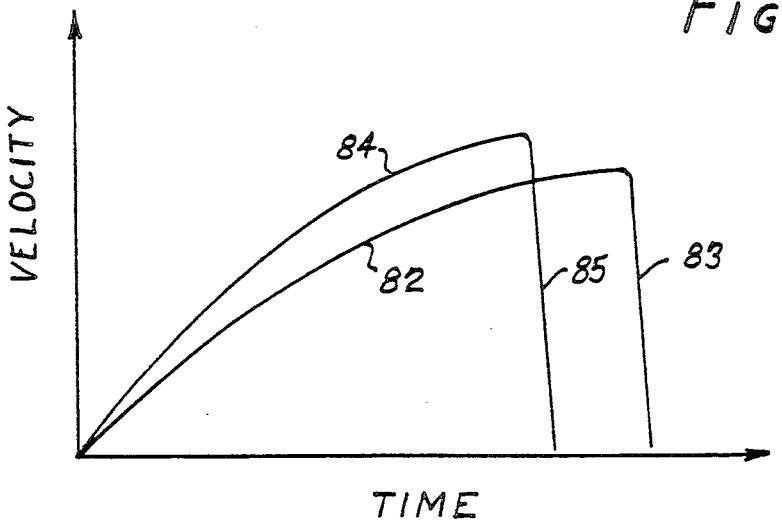
FIG. 11 is a plot of velocity versus time for showing the advantage of using a shuttle pole-piece illustrated in FIGS. 4, 7 and 8.

The advantage of using the shuttle pole-piece 70 is illustrated in FIG. 11. In the absence of this pole-piece, the downward velocity of the motion plate 33 as a function of time is a curve of the shape as generally shown at 82. The rapid drop in velocity at 83 occurs as the moving die 34 impacts against and penetrates through the work material W. Using the pole-piece 70 produces a more powerful pull on the armature causing more rapid acceleration of the motion plate, with consequent higher velocity producing a higher velocity curve of the shape as generally shown at 84, with rapid drop in velocity at 85 during performance of work. The higher velocity 84, as compared with 82, means that a more powerful and quicker tooling impact is provided, representing more efficient utilization of electric power during the work stroke and often producing a cleaner, neater shaping of the finished pieces F, because the higher rate of die closure gives less opportunity for flow of work material to occur while the dies are closing, i.e. gives less chance for distortion of the work material, and consequently there is less "spring back" in the finished pieces.

Upon completion of the work stroke, the housing of each ball-bearing bushing 36 (FIG. 2) hits a stop 38 of tough, durable, resilient, rubbery material, for example polyurethane. The motion plate 33 is then returned to its initial upper position by a pair of return compression springs 90 each seated in a spring cup 92 (FIG. 2) mounted in a counterbored socket 94 in the top plate 60. There are a pair of spring support rods 96 secured to the motion plate 33, and one of these rods extends up through each return spring. For adjusting the spring force, the upper end of each rod 96 is threaded. A knurled return-rate adjusting locknut 98 with a washer is screwed downwardly along the rod for increasing compression of the spring to increase the return force and hence to increase the rate of the return stroke.

In order to stop the upward return stroke of the motion plate 33 and to adjust the stroke length, there are a pair of annular return stops 100 (FIGS. 2, 5A and 5B) of tough, durable, resilient rubbery material, for example polyurethane, each encircling a threaded stroke-adjusting post 102 secured to motion plate 33 and upstanding through a clearance hole 103. A knurled stroke-adjusting locknut 104 supports this return stop 100. As seen by comparing FIG. 5B with FIG. 5A the stroke-adjusting nut 104 is screwed to a higher position on its post 102 for reducing the stroke length by stopping the motion plate at a lower elevation, i.e. at a lower initial position relative to the base plate 31, i.e. at a smaller "open height".

Figures 2, 2A:
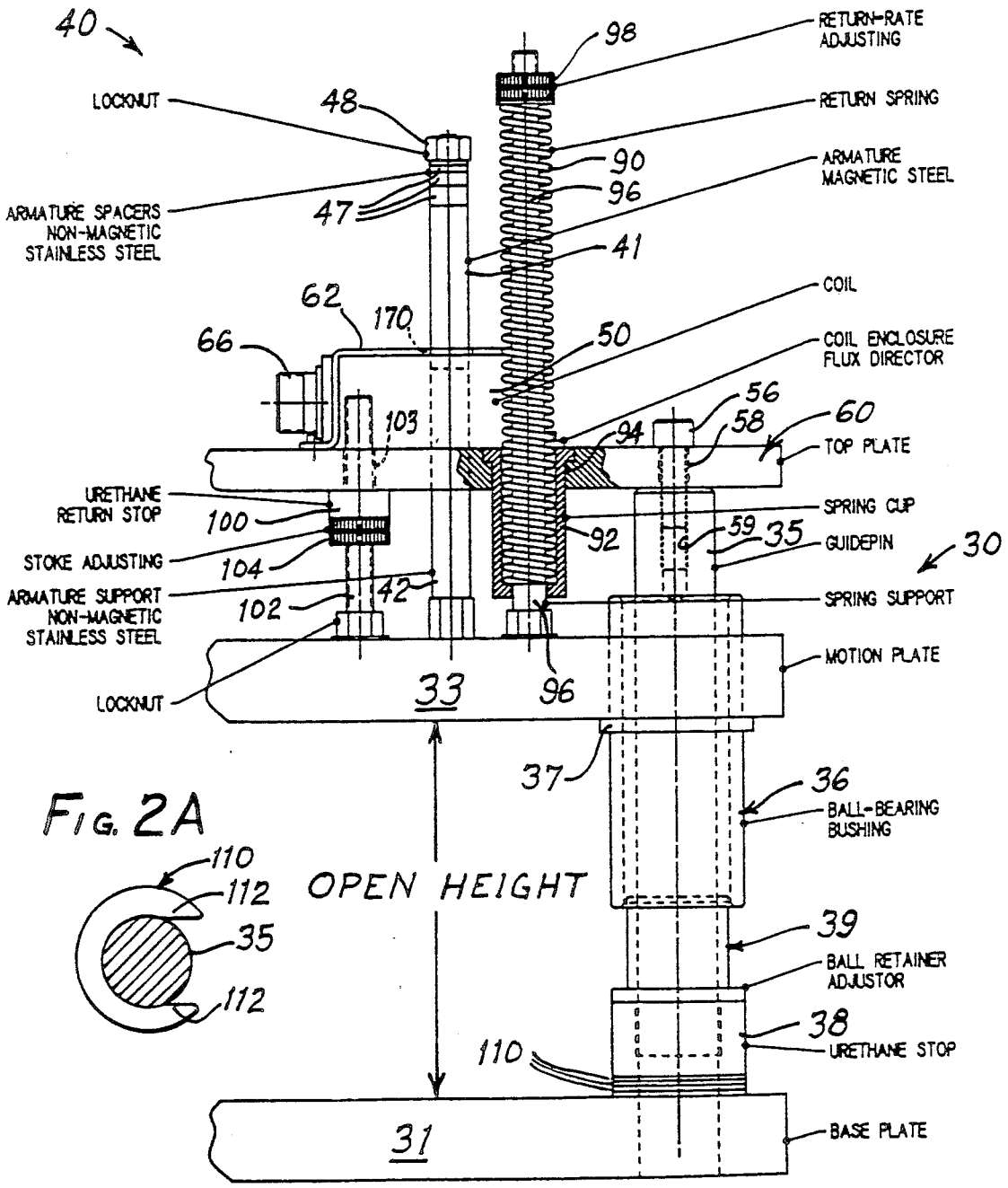
FIG. 2 is a side elevational view of the punch press of FIG. 1 as seen looking from the left in FIG. 1. The cover and cooling fan for the electromagnetic thrust motor have been removed in FIG. 2, and the rear portions of this punch press are broken away for clarity of illustration.
FIG. 2A is a plan view of a removable spacer associated with a guide pin shown in cross section and used for shut height adjustment.
Figure 3:
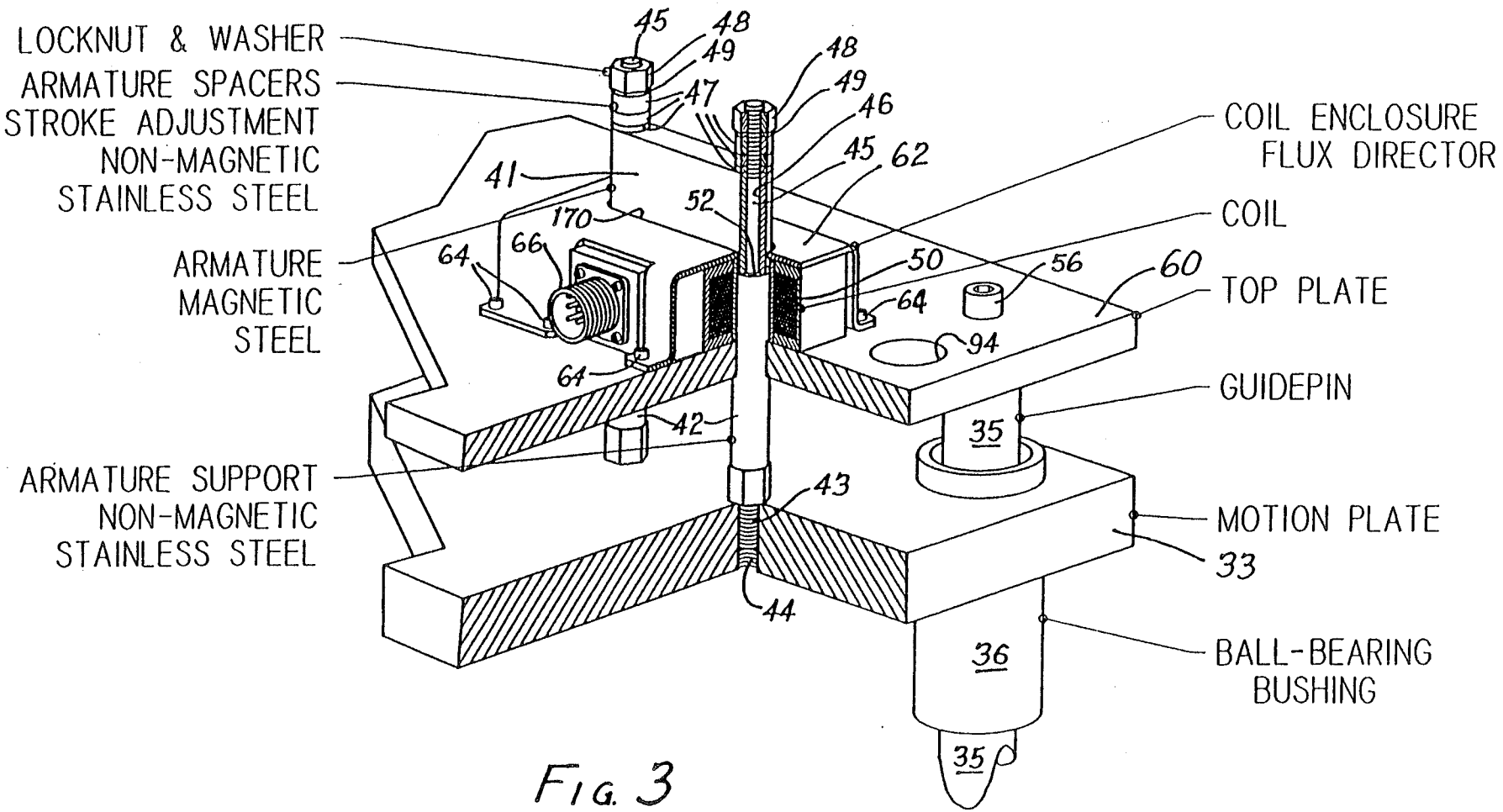
FIG. 3 is a partial perspective and sectional view as seen from above and looking at a rear electrical connector for showing the electromagnetic thrust motor mounted on a stationary top plate and having its armature connected by non-magnetic armature supports to a motion plate.

As shown in FIGS. 2 and 6A, the "open height" of the die set 30, i.e. the initial spacing between the moving and base plates 33 and 31, respectively, is determined by the initial position of the motion plate 33 relative to the base plate 31, and this open height is established by the adjusted position of the return stop 100 (FIGS. 2, 5A and 5B).

For balancing the return spring forces with the return stop actions, the return spring 90 on the left in FIG. 1 is located in front of its associated return stop 100, while the return spring at the right is located behind its associated stop, thereby providing a balanced relationship relative to the motion plate 33 and top plate 60. Moreover, the vertical centerlines of these four components left spring, left stop and right spring, right stop symmetrically straddle the vertical centerline of the armature 41 with both front-to-rear symmetry and also left-to-right symmetry.

The "shut height" of the die set 30, i.e. the final vertical spacing between the moving and base plates 33 and 31, respectively, as shown in FIG. 6B, is determined by the elevation of the top of the stops 38 above the base plate. For providing convenient adjustment of this shut height, there are a plurality of removable spacers 110 (FIG. 2), for example having thicknesses in the range of about 0.030 of an inch (about 0.75 mm) to about 0.010 of an inch (about 0.25 mm). This shut height matches the required fully closed position of the die tooling 32, 34. When the dies have become worn through normal use, their cutting edges become slightly rounded and diverging. The dies are sharpened by horizontal grinding of their opposed surfaces, thereby creating new, sharp cutting edges. This sharpening slightly reduces the overall height of the two dies. In order to compensate for this reduced die height, the die set shut height is correspondingly reduced by removing one or more of the spacers 110 from beneath the stops 38.

In order to facilitate removal of one or more of the spacers 110 for reducing shut height, these spacers 110 have a C-shape (FIG. 2A) wherein the two legs 112 are sufficiently close together at their tips for preventing accidental dislodgement of a spacer from a guide pin 35, but a spacer can be easily intentionally pulled off with pliers or wedged off with a screw driver.

Attention is now invited to FIGS. 6A and 6B for explaining operation of the anti-skid stops 39. The ball-bearing bushings 36 include multiple ball bearings 120 captured in a cage 122 (also called a "retainer"). When the motion plate 33 is in its initial open height position, as shown in FIG. 6A, the balls 120 and 122 are normally located near the lower end of the housing 124 of each bushing 36. As the motion plate moves down to the lower end of its stroke, the balls 120 roll downwardly along the guide pin 35 while they are also simultaneously rolling upwardly along the inside surface of the downwardly moving bearing housing 124. The net effect of this rolling action of the balls 120 is that the bearing housing 124 travels downwardly twice as fast and twice as far as the balls 120 and their cage 122. Consequently, when the bearing 36 reaches the limit of its down (work) stroke at the shut height, as shown in FIG. 6B, the balls and cage are now located near the top of the bearing housing 124.

In the prior art, the stopping of a bearing housing such as 124 against a stop often caused the balls and their cage to skid down inside of the bearing housing due to their downward momentum. Consequently, the balls would become improperly positioned for the return stroke, and they would skid up along the guide pin 35 during the return stroke due to the conventional retainer in the lower end of the bearing housing, causing undue wear and deterioration of the involved parts.

The anti-skid retainer stop 39 includes an annular flange shoulder 126 resting on the resilient stop 38 and an upstanding cylindrical anti-skid sleeve member 128 of sufficiently small diameter and appropriate radial thickness for projecting up into the bearing housing 124 for "kissing" the lower end of the cage 122 at the shut height position. This anti-skid sleeve 128 prevents any downward skidding of the cage and balls 122, 120; so that they are appropriately positioned for providing the desired, intended anti-friction free rolling during each return stroke.

Figure 12:
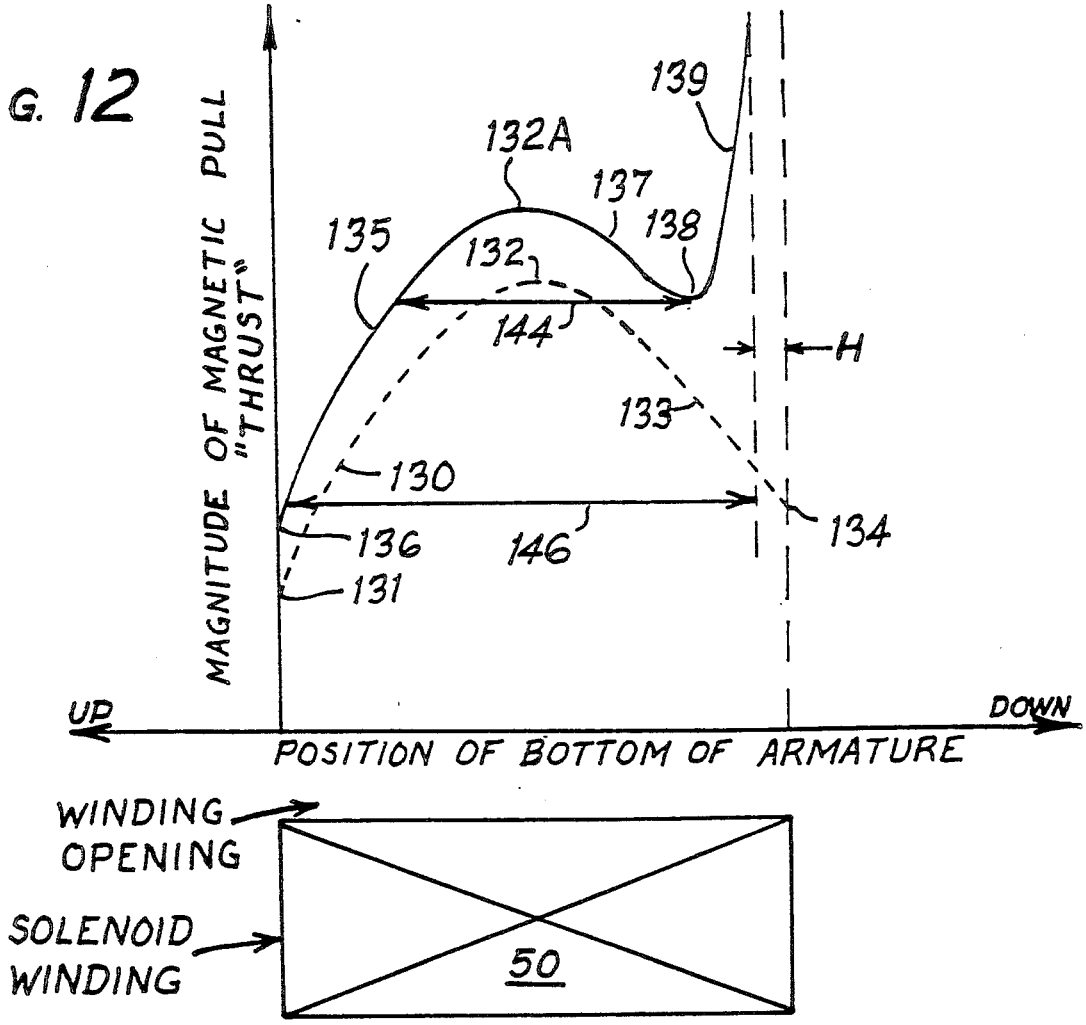
FIG. 12 is a plot of magnetic thrust force shown as a function of armature position relative to the solenoid winding.

In FIG. 12 is shown a plot 130 of the magnetic pull (force or thrust) on the armature as a function of the position of the bottom (lower end) of the armature relative to the solenoid winding. The downward thrust is at a minimum at 131 when the lower end of the armature is at the upper end of the solenoid winding. As the armature moves down, the magnitude of the downward thrust 130 (dashed curve) increases, reaching a maximum thrust value near a mid-point 132 on curve 130 when the lower end of the armature is half-way into the winding. Thereafter, the downward thrust decreases along the dashed curve in region 133 as the armature continues to move down. The dashed curve 130, 133 indicates the pattern of thrust which occurs in the absence of the shuttle pole-piece 70 (FIGS. 4, 7 and 8). This dashed curve reaches another minimum at 134.

The armature in this embodiment is longer in the stroke direction than the axial length of the winding, and thus there is significant pull at 134 because the armature is still being pulled down toward a symmetrical position relative to the winding.

In the presence of the pole-piece 70, which extends a distance "H" into the winding opening, the solid-line curve 135 indicates the pull pattern. A somewhat higher initial pull 136 occurs and a higher mid-point maximum thrust 132A near mid-point is provided. The thrust pattern 137 then decreases somewhat until the lower end of the armature is relatively close at 138 to the pole-piece 70, being another minimum, whereupon the attraction between the lower end of the armature and the pole 72 increase dramatically at 139 during the final closure between them.

The considerably larger area under the solid-line curve 135, 137, 139 as compared with the area under the dashed curve 130, 133 indicates the additional amount of energy (additional amount of available capability for performing foot-pounds of work) which is provided by installing the shuttle pole-piece 70.

The value of H (FIGS. 7 and 8) for the shuttle pole-piece is advantageously in the preferred range of about 1/16th to about 5/16ths of an inch. In this preferred embodiment, H has a value of about ⅛th to 3/16ths of an inch.

When the work material and tooling 32, 34 require a relatively short work stroke, as shown by a double-headed arrow 144, it is desirable to have this short work stroke 144 generally symmetrically positioned relative to the central maximum 132A for maximizing the integrated energy (area under the curve) available from the magnetic thrust curve 135, 132A, 137 for most effectively accelerating the motion plate 33. When a longer work stroke is required, as shown by a double-headed arrow 146, it is still desirable to have this longer work stroke 146 be located generally symmetrically positioned relative to the central maximum 132A, because the mass of the motion plate 33 and associated moving components need to be accelerated for accumulating kinetic energy. The brief large thrust 139 occurs over such a short portion of the stroke length that it does not have much opportunity to produce much tool acceleration in and of itself, but the presence of this shuttle pole-piece 70 does significantly increase the magnitude of the magnetic pull 135-137-139 available throughout the whole stroke, thus resulting in the higher velocity curve 84 in FIG. 11. About 20% of additional work capability is provided by installing such a shuttle pole-piece. The broad-rounded shape of the thrust curve 135, 137 near its maximum 132A has a relatively longer time in which to integrate its accelerating effect into a relatively higher tool velocity and higher kinetic energy prior to impact.

In this preferred embodiment, the axial length of the winding opening 54 is about 1.75 inches. The armature length in the stroke direction is about 3.0 inches. Thus, in this embodiment the armature length in the stroke direction is about 170% of the axial length of the winding opening. Increasing this armature length above a relative length of about 215% does not significantly further increase the available energy (area under the solid-line curve 135, 137, 139). Conversely, decreasing this armature length below about 140% of the axial length of the winding does significantly decrease the available energy. In summary, the preferred relative length of the armature is in the range from about 140% to about 215%, a more preferred relative length is in the range of about 150% to about 200% and an optimum is in the range of about 160% to about 190%.

The impact force "IF" which is available for doing work of the tooling against the work material is expressed by:

$$IF = Magnetic\ Thrust + \tfrac{1}{2}(MV^2)/d \qquad (1)$$

"M" is the total effective mass of the moving components exerted on the male die 34; "V" is the velocity of this effective mass; and "d" is the stopping distance. It will be appreciated that the "$MV^2$" term is of far larger magnitude than the Magnetic Thrust in providing impact force, because $MV^2$ represents the accumulated (integrated acceleration) effect of the magnetic thrust applied to mass M over the whole stroke length for producing velocity V prior to the moment of impact.

The energy "E" available to provide useful work in forming the finished pieces F is expressed by:

$$E = Td + \tfrac{1}{2}MV^2 \qquad (2)$$

"T" is the magnetic thrust, and "d" is the stopping distance. At least most of this stopping distance involves working of the material. It is assumed that the value of T remains relatively constant over the stopping distance d, which is a relatively short distance. Again, it will be appreciated that the second term of this energy equation (2) involves the square of velocity V and is by far the dominant factor and consequently every effort is desirable toward maximizing velocity V prior to the instant of impact.

For optimizing the relationship of armature thrust relative to stroke length, the elevation of the armature 41 above the motion plate 33 is adjusted by the spacers 47 already described stored on the upper end of the upper studs 45 of the armature supports 42. These spacers are used to adjust the effective length of the armature supports (thrust rods) 42, as will now be further explained with reference to FIGS. 5A, B and C. For example, there are three spacers 47 having the respective thicknesses 0.125, 0.250 and 0.375 of an inch (3.18, 6.35 and 9.53 mm). For example, the armature spacer chart 140 in FIG. 5C is shown to cover a range of adjustable stroke length settings from 1.50 inches (38.1 mm) to zero using three such spacers 47. The words "SPACERS NEEDED" indicates the utilization of spacers placed below the armature 41 on the shoulder 52 at the lower end of the stud 45 for effectively lengthening the armature supports (push rods) 42. For the longest stroke setting, in the range from 1.38 to 1.50 of an inch, none of the spacers are placed on the shoulder 52 at the bottom of the stud 45 below the armature 41. For the shortest stroke setting, in the range from 0.00 to 0.25 of an inch, all three of the spacers 47 are placed on the shoulder 52 below the armature, as indicated by three rectangular marks 142. For intermediate stroke length settings, as shown in the chart 140, various combinations of these three spacers 47 are used for optimizing armature thrust relative to stroke length.

In order to reduce the stroke length, as explained previously in detail, the return stop 100 is positioned higher on its adjustment post 102 by turning up the stroke-length adjusting lockout 104, and vice versa.

For quick and convenient change-over between die sets for providing different production runs, the motor 40 is removed and transferred to another die set 30 having a different tooling set up. To accomplish such interchanging of the motor, the housing 21 (FIG. 1) is temporarily removed; the cap screws 56 and spring return-rate adjusting nuts 98 are removed. Then the top (deck) plate 60 is moved to the next die set together with the springs 90, spring cups 92, solenoid winding 50 and its enclosure 62 and with the motor housing 21 and cooling fan 23. The armature 41 remains attached to the motion plate 33 for retaining its adjustment, and similarly the return stop 100 remains for retaining its adjustment in readiness for subsequent use of the die set 30, without incurring loss of time and machinist's expense for tooling set-up.

Figure 9:
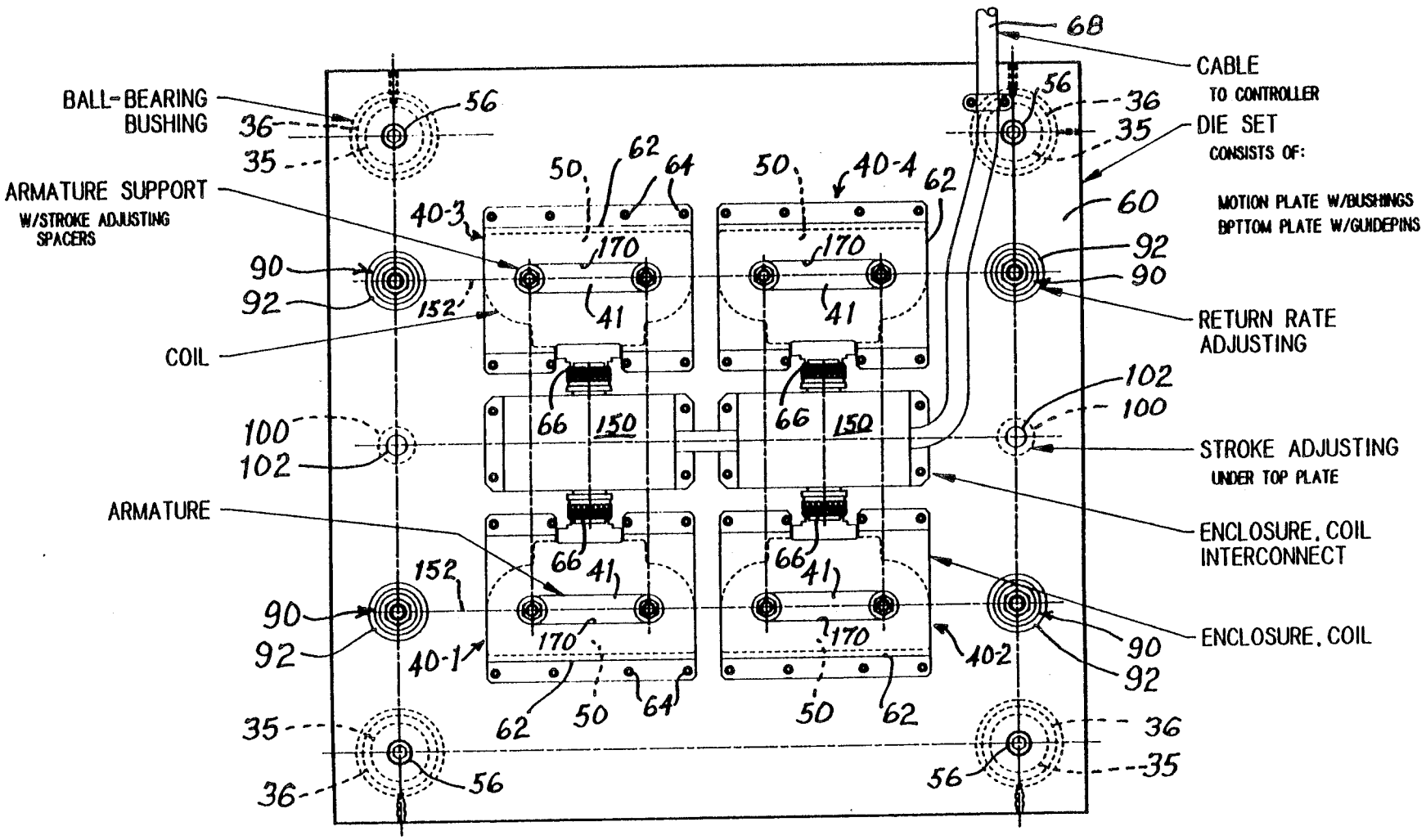
FIG. 9 is a top plan view of a top plate having four electromagnetic thrust motors mounted on it and showing their electrical connectors to a power cable.

As shown in FIG. 9, the top plate 60 can be arranged for supporting a plurality, for example four thrust motors 40-1, 40-2, 40-3 and 40-4, each including a solenoid winding 50 and associated armature 41. The respective electrical connectors 66 are arranged to face toward each other in pairs for accommodating interconnection connectors 150 with their electrical cable 68. Also, for example, four return springs 90 with rate adjusting capability can be provided, symmetrically positioned front-to-back relative to the stroke adjusting stops 100 and also aligned left-to-right relative t horizontal centerlines 152 of the intervening armatures.

Among the advantages of using multiple thrust motors 40-1, 40-2, 40-3 and 40-4, as shown in FIG. 9, arranged symmetrically on the top plate 60 are those resulting from the fact that the down thrusts from their four armatures are coupled to the moving plate at multiple points distributed substantially uniformly over the area of the moving plate, and such uniform distribution of the down thrust is well adapted for use with tooling dies arranged for working a relatively large area of work material.

By electrically connecting their solenoid windings 50 in parallel to the power source, the total down thrust becomes four times that of a single motor 40. By electrically connecting their windings 50 in series, the electrical current becomes one-fourth as large as would occur with the same electric power source applied to a single one of such windings. Since the heating effect of electric current is a function of the square of the current, a reduction of the current to one-fourth reduces the heating effect in each winding to one-sixteenth, and thus the total overall heating from these four windings is one-quarter that for a single winding being energized from the same power source. Moreover, since the total number of winding turns in four windings is four times that for a single winding, the total down thrust remains substantially the same as for such single winding, because magnetic force is a function of current times turns ("ampere turns") and there is one-fourth as much current flowing through four times as many turns. Reducing the heating effect enables the repetition rate (number of strokes per minute) of the punch press to be increased for increasing production without overheating the electromagnets. By connecting each two windings in series and then connecting two series pairs in parallel (in a series, parallel combination) the total amount of thrust is doubled, while the total amount of heating is reduced to one-half.

Figure 10:
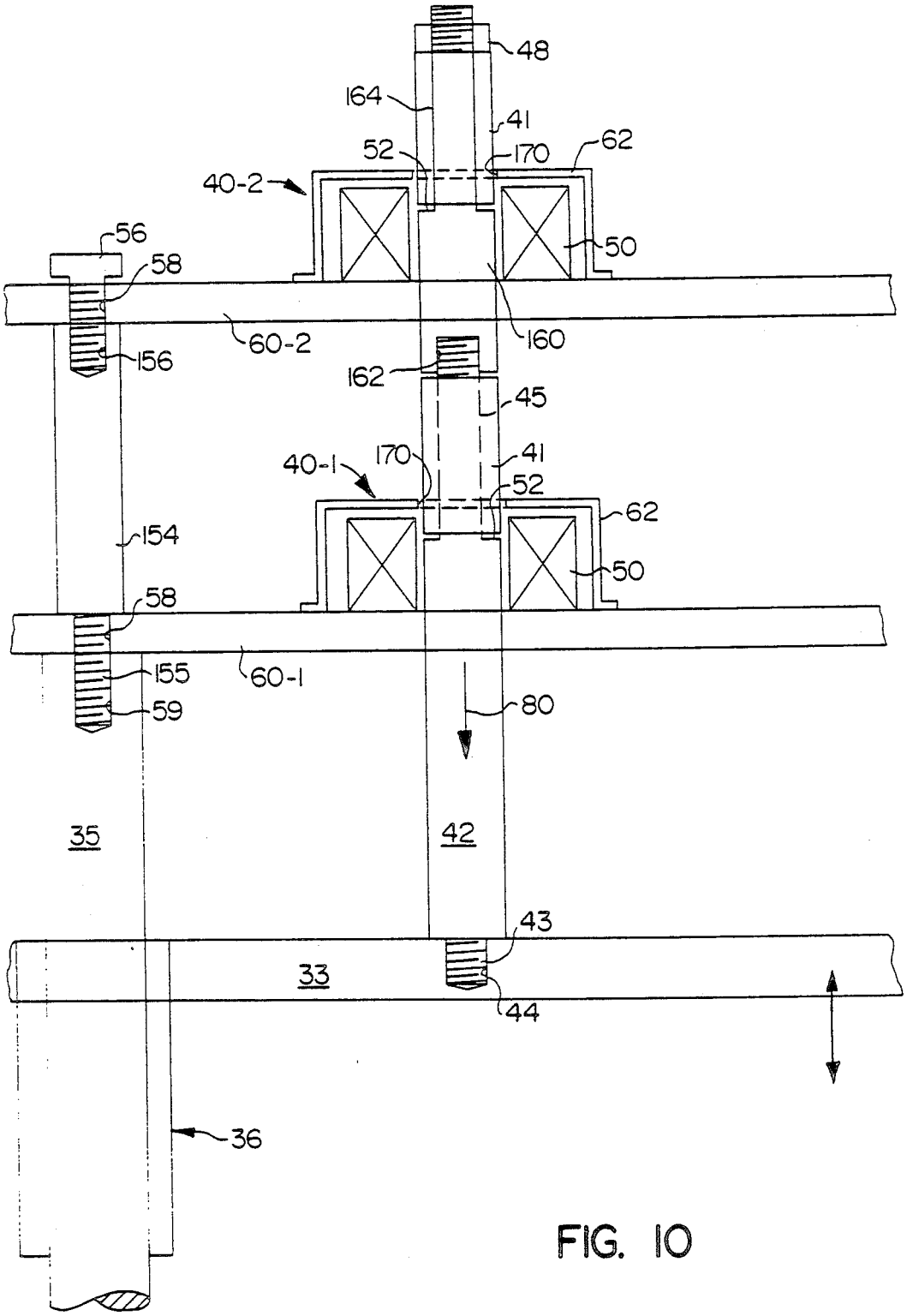
FIG. 10 is a partial elevational sectional view illustrating two electromagnetic thrust motors mounted one above another in vertical alignment similar to two stories in a building.

As shown in FIG. 10, a plurality of thrust motors 40-1 and 40-2 can be mounted one above another in vertical alignment. The cap screws 56 are removed from their sockets 59 in the guide pins 35, and motor support posts 154 each having a threaded stud 155 are screwed into the respective sockets 59 for holding the lower top plate (deck) 60-1. The upper top plate or deck 60-2 is attached to the motor support posts 154 by cap screws 56 engaging into threaded sockets 156 in the top end of each support post.

Similarly, non-magnetic push rod extenders 160 of structurally rigid non-magnetic materials, such as previously described for the armature supports 42, have their threaded sockets 162 engaged on the armature support studs 45 for holding the armature 41 of the lower motor 40-1. Each extender 160 has a threaded stud 164 for holding the armature 41 of the upper motor 40-2. It is to be understood that armature spacers, such as shown at 47 in FIGS. 1, 2, 3, 4, 5A and 5B, can be provided for adjusting the positions of the respective armatures 41 relative to the stroke length required by the tooling. Moreover, their thrust curves (FIG. 12) may be slightly offset (staggered) for optimizing the value "V" in equations (1) and (2) prior to the instant of impact.

Among the advantages of vertically stacking the thrust motors, as shown in FIG. 10, is that the down thrust 80 which is coupled to the moving plate 33 can be focused in a relatively small area as may be desired when the tooling requires a large force to be applied to a small surface area of the work material. As discussed regarding FIG. 9, the windings 50 of the two thrust motors 40-1 and 40-2 in FIG. 10 can be connected in parallel to the electric power source for doubling their total down thrust 80. By connecting their windings 50 in series to the power source, the current reduces to one half, and thus the heating effect in each winding is reduced to one-quarter. The down thrust remains substantially the same as for a single winding connected to the same power source because one-half the amount of current is flowing through twice as many turns. Thus, the number of strokes per minute can be increased for increasing production. By virtue of using two thrust motors with one-fourth as much heating effect in each of them, this reduced heat can be better dissipated from the two motors than from a single one, and thus as a practical matter the number of strokes per minute can be increased to about three to four times that for a single thrust motor.

Inviting attention back to FIGS. 6A and 6B, it is noted that the ball-bearing bushings 36 include a retaining ring 166 located within the bearing housing 124 near its upper end. This retaining ring 166 protrudes into the bore 168 of the bearing housing 124 for providing an annular shoulder projecting radially into the bore for retaining the cage 122 and balls 120 within the bore 168 to prevent them from accidentally coming out of an end of the bearing housing. Normally, there is also a similar retaining ring in the bore 168 at the lower end of the bearing housing. These ball-bearing bushings 36 are specially configured to omit a second retaining ring in accord with the present invention. In order to provide clearance for entry of the anti-skid sleeve element 128 into the bore 168, as shown in FIG. 6B, there is no retaining ring at the lower end of the ball-bearing bushing. The anti-skid element 128 prevents downward skidding of balls 120 and cage 122. Consequently, in FIG. 6B, the balls and cage are kept at a high position relative to the bearing housing 124, and therefore they do not come out of the lower end of the bore 168 when they are at a low position relative to the bearing housing in FIG. 6A.

With further reference to FIGS. 1, 3, 4, 5A, 5B, 7, 8 and 10, it is noted that the winding enclosure flux director 62 has an passageway 170 at the top of the solenoid winding 50. This enclosure opening 170 is aligned with the winding opening 54, and the edges of this opening 170 serve as an upper pole-piece positioned close to the side surfaces of the armature 41 and serving to direct magnetic flux 73 (FIG. 7) into the armature. Also, please note in FIGS. 7 and 8 that the large area of the ferromagnetic top mounting plate 60 very effectively serves to capture stray ("leakage") magnetic flux. Such stray flux is outside of the ferromagnetic enclosure 62 and couples to the armature 41 above the opening 170 in this enclosure, as shown by the dashed lines 172. This ferromagnetic top mounting plate 60 in capturing such stray flux thereby greatly minimizes the existence of any stray flux below this mounting plate 60. The stray flux 172 which couples to this ferromagnetic plate 60 is directed inwardly at 174 toward the shuttle pole-piece 70 instead of looping down and causing magnetization of the tooling 34, 32 or the guide pins 35 or bushings 36. As shown in FIG. 7, this ferromagnetic top mounting member 60 is positioned a distance "X" of at least about two inches (at least about 50 mm) above the initial position of motion member 33 for establishing this distance of air space for providing the large reluctance of such air space below the ferromagnetic top plate for further isolating the tooling from magnetization.

Thus, the ferromagnetic top mounting plate member 60, ferromagnetic enclosure 62 and ferromagnetic shuttle pole-piece 70 in cooperation with the elevation of the top plate above the motion plate 33 and the non-magnetic push rods 42 advantageously serve to isolate substantially the magnetic and heating effects of the winding from the upper and base tooling 34 and 32. The airflow from the cooling fan carries away heat by outflow of air through the side outlet ports 25 located above the top plate and further serving to isolate heating effects from the tooling.

For convenience of describing the electromagnetic punch press embodiments of this invention in a readily understood manner with reference to the accompanying drawings, it is noted that various punch press components are shown and described as being oriented vertically in upstanding relationship relative to the horizon, such that the work stroke involves a downward motion and the subsequent return stroke involves an upward motion, because such a vertical orientation is the usual or normal orientation of a punch press when installed in a manufacturing plant. However, it is to be understood that the electromagnetic punch press embodiments of this invention are capable of operating when oriented at any desired orientation relative to the horizon. Therefore, words such as "upstanding", "vertical", "vertically", "down", "downward", "downwardly", "up", "upwardly", "upper", "lower", "above", "horizontal", "top", "bottom", and the like, are not intended to be limiting but rather are intended to be interpreted as describing the various punch press components in the particular orientation in which they are herein illustrated, with the clear understanding that such electromagnetically driven punch presses can be oriented and operated vertically or horizontally or at any desired slanted orientation between vertical and horizontal as may be required or desired due to circumstances occurring at a particular installation or utilization site.

Since other changes and modifications varied to fit particular operating requirements and environments will become recognized by those skilled in the art, the invention is not considered limited to the examples chosen for purposes of illustration of presently preferred embodiments and includes all changes and modifications which do not constitute a departure from the true spirit and scope of this invention as claimed in the following claims and equivalents of the claimed elements.

I claim:

1. In an electromagnetically driven punch press including a base for mounting base tooling and having a plurality of guide pins upstanding from the base in spaced relationship among said guide pins, and a motion member above the base for mounting upper tooling above the base tooling, said motion member being carried by bushings mounted to the motion member, respective bushings being movable downwardly along respective guide pins during a downward stroke of said motion member and being movable upwardly along the respective guide pins during an upward return stroke of said motion member, the invention comprising:

said guide pins extending up through said bushings to upper ends of the guide pins at an elevation at least about two inches (at least about 50 mm) above said motion member when said motion member is at an initial position prior to its downward stroke, a top mounting member attached to said upper ends of said guide pins, said top mounting member being ferromagnetic, said ferromagnetic top mounting member being at an elevation at least about two inches (at least about 50 mm) above said motion member when said motion member is at said initial position, a solenoid winding mounted above said top mounting member and having a vertical opening surrounded by said winding, a vertically movable ferromagnetic armature aligned with said winding opening and being movable downwardly and upwardly in said winding opening, a ferromagnetic enclosure for said winding, said ferromagnetic enclosure being over a top of the solenoid winding and being mounted to said mounting member, said ferromagnetic enclosure having an opening positioned near the top of said winding aligned with said winding opening, said armature extending up through said opening in said ferromagnetic enclosure, said top mounting member having an opening positioned near the bottom of said winding aligned with said winding opening, a pair of non-magnetic push rods connected to said armature and extending down through said opening in said top mounting member and being connected to said motion member for driving said motion member downwardly upon electrical energization of said solenoid winding, and return means mounted on said top mounting member and being connected to said motion member for moving said motion member in said upward return stroke.

2. In an electromagnetically driven punch press, the invention claimed in claim 1, wherein:

said ferromagnetic top mounting member and said ferromagnetic enclosure with said armature extending upwardly through said opening in said ferromagnetic enclosure in cooperation with said elevation of said top mounting member above said motion member and said non-magnetic push rods serves for substantially isolating magnetic effects of said solenoid winding from the upper tooling and base tooling.

3. In an electromagnetically driven punch press, the invention claimed in claim 2, further comprising:

said ferromagnetic top mounting member having an overall horizontal extent comparable with an overall horizontal extent of said motion member, thereby said ferromagnetic top mounting member captures stray magnetic flux produced by electrical energization of said solenoid winding, such stray magnetic flux being outside of said ferromagnetic enclosure, and said ferromagnetic top mounting member directing captured stray flux inwardly generally toward a lower end of the winding opening.

4. In an electromagnetically driven punch press, the invention claimed in claim 1, wherein:

said solenoid winding opening has a predetermined length in the direction of motion of said armature, and said armature has a preferred length in said direction of motion in the range of about 140% to about 215% of said length of said winding opening for causing said armature to continue extending upwardly through said opening in said ferromagnetic enclosure during an entire downward stroke of said motion member.

5. In an electromagnetically driven punch press, the invention claimed in claim 1, wherein:

said solenoid winding opening has a predetermined length in the direction of motion of said armature, and said armature has a more preferred length in said direction of motion in the range of about 150% to about 200% of said length of said winding opening for causing said armature to continue extending upwardly through said opening in said ferromagnetic enclosure during an entire downward stroke of said motion member.

6. In an electromagnetically driven punch press, the invention claimed in claim 1, wherein:

said solenoid winding opening has a predetermined length in the direction of motion of said armature, and said armature has an optimum length in said direction of motion in the range of about 160% to about 190% of said length of said winding opening for causing said armature to continue extending upwardly through said opening in said ferromagnetic enclosure during an entire downward stroke of said motion member.

7. In an electromagnetic punch press, the invention claimed in claim 1, further comprising:

a cooling housing mounted to said top mounting member for housing said solenoid winding and its winding enclosure together with said armature extending up through said opening in said enclosure, said cooling housing having an air intake opening and at least one air outlet port, and a cooling fan associated with said cooling housing for flowing air into said housing through said intake opening and out of said housing through said outlet port for causing such flowing air to cool the armature, the solenoid winding and its enclosure.

8. In an electromagnetic punch press, the invention claimed in claim 7, further characterized in that:

said air intake opening is located in a top of said cooling housing above the armature, the solenoid winding and its enclosure, there are a plurality of outlet ports, said outlet ports are located in a plurality of sides of said housing near said top mounting member, and said cooling fan blows air directly down from said air intake opening onto said armature and said winding enclosure, with the air thereafter exiting through said outlet ports for carrying away heat.

9. In an electromagnetic punch press, the invention claimed in claim 1 wherein:

said ferromagnetic top mounting member is a ferromagnetic top plate, said invention further comprising:

a shuttle pole-piece having a pole of ferromagnetic material, said pole being located in said opening in said ferromagnetic top plate, mounting means for said shuttle pole-piece for enabling said pole to move up and down within said opening in said ferromagnetic top plate, resilient means urging said pole upwardly to an initial position, said pole in said initial position projecting upwardly partially into said winding opening, and said pole being movable downwardly overcoming the urging of said resilient means upon contact with the armature during downward motion of the armature.

10. In an electromagnetically driven punch press, the invention claimed in claim 9, wherein:

said ferromagnetic pole of said shuttle pole-piece is located between said pair of non-magnetic push rods.

11. In an electromagnetically driven punch press, the invention claimed in claim 9, characterized further in that:

said shuttle pole-piece has a pair of ferromagnetic flanges projecting horizontally from opposite sides of said pole, and said ferromagnetic flanges are in abutting relationship against an underside of said ferromagnetic top plate when said ferromagnetic pole is in said initial position.

12. In an electromagnetically driven punch press, the invention claimed in claim 11, further characterized in that:

each of said flanges has a vertical hole therein, said mounting means comprise a pair of vertical rods attached to said top plate on opposite sides of said opening in said top plate, respective ones of said rods extend down from said top plate through respective vertical holes in said flanges, said resilient means comprise a pair of springs positioned below respective flanges, and said springs are carried by the respective rods and urge said flanges upwardly toward said top plate.

13. In an electromagnetically driven punch press, the invention claimed in claim 9, further comprising:

said ferromagnetic top plate having an overall horizontal extent comparable with an overall horizontal extent of said motion member, thereby said ferromagnetic top plate captures stray magnetic flux produced by electrical energization of said solenoid winding, such stray magnetic flux being outside of said ferromagnetic enclosure, and said ferromagnetic top plate directing captured stray flux inwardly generally toward said shuttle pole-piece.

14. In an electromagnetically driven punch press, the invention claimed in claim 1, further comprising:

first adjusting means for adjusting said initial position of said motion member, said first adjusting means comprising:

at least one adjustment post mounted to said motion member and upstanding from said motion member, said top mounting member having a clearance hole therein,.

said adjustment post extending up through said clearance hole, a resilient stop adjustable upwardly and downwardly along said adjustment post, said resilient stop being located below said top mounting member for coming into contact with said top mounting member for stopping said upward stroke, and means for holding said resilient stop in its adjusted position on said post.

15. In an electromagnetically driven punch press, the invention claimed in claim 14, further comprising:

second adjusting means for adjusting the vertical position of said armature relative to said motion member in relationship to said initial position of said motion member for optimizing the relationship of the armature to said solenoid winding, and said second adjusting means changes the effective length of said non-magnetic push rods between said motion member and the armature.

16. In an electromagnetically driven punch press, the invention claimed in claim 15, wherein:

said second adjusting means which changes the effective length of said non-magnetic push rods between said motion member and the armature comprises:

a shoulder on each of said push rods, a threaded stud upstanding above said shoulder on each push rod, the armature having a pair of vertical mounting passages therein for receiving the respective threaded studs, a removable locknut on each threaded stud for holding the armature thereon, and at least one removable non-magnetic spacer adapted to be placed around said stud for seating on said shoulder below the armature.

17. In an electromagnetically driven punch press, the invention claimed in claim 15 characterized further in that:

said top mounting member is removably attached to the upper ends of said guide pins, said return means are removably connected to said motion member, and the armature can be withdrawn down through said winding opening and said opening in said top mounting member, thereby enabling the top mounting member and said solenoid winding and said enclosure and said return means to be moved to another punch press without disturbing said first and second adjusting means.

18. An electromagnetic thrust motor for use in operating a die set in a punch press and wherein said die set includes a base for mounting base tooling with a plurality of guide pins upstanding from said base and a motion member for mounting upper tooling above said base tooling, said motion member being movable downwardly and upwardly along said guide pins, said electromagnetic thrust motor comprising:

a top mounting member adapted to be attached to upper portions of said guide pins above said motion member for positioning said top mounting member above said motion member, at least one solenoid winding mounted onto said top mounting member above said top mounting member, said solenoid winding having a winding opening extending vertically through said winding, said top mounting member having an opening extending vertically therethrough below said winding opening and being aligned with said winding opening, ferromagnetic enclosure means at least partially enclosing said solenoid winding and defining a passageway extending vertically therethrough above said winding opening and being aligned with said winding opening, a ferromagnetic armature movable downwardly and upwardly in said winding opening, said ferromagnetic armature extending upwardly through said passageway in said enclosure means, a pair of non-magnetic push rods connected to said armature and extending down through said opening in said top mounting member and being connectable to said motion member for thrusting said motion member downward from an initial position upon electrical energization of said solenoid winding, and return means mounted on said top mounting member and being connectable to said motion member for returning said motion member upwardly to said initial position following such downward thrusting of said motion member.

19. The electromagnetic thrust motor claimed in claim 18, characterized further in that:

said top mounting member is ferromagnetic, said ferromagnetic top mounting member has an overall horizontal extent comparable with an overall horizontal extent of said motion member for aiding in substantially isolating said tooling from magnetization due to electrical energization of said solenoid winding.

20. The electromagnetic thrust motor claimed in claim 19, characterized further in that:

said ferromagnetic top mounting member is positioned at a distance of at least about two inches (at least about 50 mm) above said motion member when said motion member is in said initial position, and said positioning of said ferromagnetic top mounting member at said distance above said motion member provides an air space for aiding in substantially isolating said tooling from magnetization due to electrical energization of said solenoid winding.

21. The electromagnetic thrust motor claimed in claim 18, characterized further in that:

said top mounting member is ferromagnetic, a ferromagnetic shuttle pole-piece is movably mounted in said opening in said ferromagnetic top mounting member for increasing the down thrust occurring on the armature upon electrical energization of said solenoid winding, said shuttle pole-piece is movable downwardly and upwardly in said opening in said ferromagnetic top mounting member, resilient means urge said shuttle pole-piece upwardly to a normal position projecting partially into said winding opening, and said shuttle pole-piece is moved downwardly upon said armature coming into contact with said shuttle pole-piece during downward motion of the armature for minimizing impact and mechanical shock of the armature hitting said shuttle pole-piece.

22. The electromagnetic thrust motor claimed in claim 21, wherein:

said ferromagnetic shuttle pole-piece is mounted in said opening in said ferromagnetic top member between said pair of non-magnetic push rods.

23. The electromagnetic thrust motor claimed in claim 21, wherein:

said ferromagnetic shuttle pole-piece has a pair of ferromagnetic flanges projecting horizontally from opposite sides, and said resilient means urge said flanges upwardly into abutting relationship against said ferromagnetic top mounting member in said normal position of said shuttle pole-piece.

24. The electromagnetic thrust motor claimed in claim 23, wherein:

each of said flanges has a vertical hole therein, a pair of vertical mounting rods attached to said top mounting member on opposite sides of said opening in said top mounting member, respective ones of said mounting rods extend down through respective holes in said flanges, said resilient means comprise a pair of compression springs carried on the respective mounting rods below the flanges and pushing upwardly on the respective flanges.

25. The electromagnetic thrust motor claimed in claim 21, further comprising:

said winding opening has a predetermined vertical length, and the armature has a vertical length in the range of about 140% to about 215% of said predetermined vertical length of said winding opening for causing said armature to continue extending upwardly through said passageway in said ferromagnetic enclosure means during an entire downward thrusting of said motion member.

26. The electromagnetic thrust motor claimed in claim 25, further characterized in that:

said shuttle pole-piece in said normal position projects upwardly into said winding opening by an amount in the range from about 1/16th to about 5/16ths of an inch.

27. The electromagnetic thrust motor claimed in claim 26, wherein:

said winding opening has a vertical length of about 1.75 inches.

28. The electromagnetic thrust motor claimed in claim 27, wherein:

said shuttle pole-piece in said normal position projects upwardly into said winding opening by an amount in the range from about ⅛th to about 3/16ths of an inch.

29. The electromagnetic thrust motor claimed in claim 18, further characterized in that:

said winding opening has a predetermined vertical length, and the armature has a vertical length in the range of about 140% to about 215% of said predetermined vertical length of said winding opening for causing said armature to continue extending upwardly through said passageway in said ferromagnetic enclosure means during an entire downward thrusting of said motion member.

30. The electromagnetic thrust motor claimed in claim 29, further comprising:

first adjusting means for adjusting the initial position of said motion member relative to said top mounting member, and second adjusting means for adjusting the effective length of each of said non-magnetic push rods for adjusting an initial vertical position of the armature relative to said winding opening.

31. The electromagnetic thrust motor claimed in claim 30, wherein:

said second adjusting means comprises:

a shoulder on each of said push rods, a pair of threaded studs, a respective one of said studs upstanding above a respective one of said shoulders, the armature having a pair of vertical mounting passages therein for mounting the armature on said studs above said shoulders, a removable locknut on each threaded stud for holding the armature thereon, and at least one removable non-magnetic spacer ring adapted to encircle each stud between said shoulder and the armature for adjusting the vertical mounting position of the armature on the respective stud.

32. The electromagnetic thrust motor as claimed in claim 31, wherein:

said pair of studs are sufficiently long for enabling at least one unused non-magnetic spacer ring to be stored temporarily on each stud above the armature and below the locknut.

33. An electromagnetic thrust motor system for use in operating a die set in a punch press and wherein said die set includes a base for mounting base tooling with a plurality of guide pins upstanding from said base and a motion member for mounting upper tooling above said base tooling, said motion member being movable downwardly and upwardly along said guide pins, said electromagnetic thrust motor system comprising:

a top mounting member adapted to be attached to upper portions of said guide pins above said motion member for positioning said top mounting member above said motion member, a plurality of solenoid windings mounted onto said top mounting member above said top mounting member, each of said solenoid windings having a winding opening extending vertically through said winding, said top mounting member having a respective opening extending vertically therethrough below each of said winding openings and each such respective opening being aligned with the winding opening below which such respective opening is located, ferromagnetic enclosure means at least partially enclosing each of said solenoid windings and defining a passageway extending vertically therethrough above each winding opening and being aligned with the respective winding opening, a plurality of ferromagnetic armatures, each ferromagnetic armature being movable downwardly and upwardly in the respective winding opening, each ferromagnetic armature extending upwardly through the respective passageway in the enclosure means, a plurality of non-magnetic push rods, at least one respective non-magnetic push rod being connected to a respective armature and extending down through a respective opening in said top mounting member and being connected to said motion member for thrusting said motion member downward from an initial position upon electrical energization of said plurality of solenoid windings, and return means mounted on said top mounting member and being connected to said motion member for returning said motion member upwardly to said initial position following such downward thrusting of said motion member.

34. The electromagnetic thrust motor system claimed in claim 33, further characterized in that:

said plurality of solenoid windings are connected electrically in parallel to an electrical power source for increasing the down thrust on said motion member as compared with one of said solenoid windings alone being connected to said power source.

35. The electromagnetic thrust motor system claimed in claim 33, further characterized in that:

the number of said solenoid windings mounted onto said top mounting member is "N", said solenoid windings are electrically connected in series to an electrical power source for providing substantially the same total down thrust as provided by a single one of said solenoid windings when electrically connected alone to the same source, and thereby the heating effect of electrical current in each winding is reduced to $1/N^2$ as compared with the heating effect in such single winding alone.

36. The electromagnetic thrust motor system claimed in claim 33, further characterized in that:

there are four of said solenoid windings, a first pair of said solenoid windings are electrically connected in series, a second pair of said solenoid windings are electrically connected in series, said first and second pairs are electrically connected in parallel to an electrical power source, thereby reducing the heating effect of electrical current in each solenoid winding to about $\frac{1}{4}$th the heating effect in a single one of said windings alone connected to the same power source, and thereby producing a total down thrust about twice that produced by such single one of said windings.

37. An electromagnetic thrust motor system for use in operating a die set in a punch press and wherein said die set includes a base for mounting base tooling with a plurality of guide pins upstanding from said base and a motion member for mounting upper tooling above said base tooling, said motion member being movable downwardly and upwardly along said guide pins, said electromagnetic thrust motor system comprising:

a first mounting member adapted to be attached to upper portions of said guide pins above said motion member for positioning said first mounting member above said motion member, a first solenoid winding mounted onto said first mounting member above said first mounting member, said first solenoid winding having a first winding opening extending vertically through said first winding, said first mounting member having an opening extending vertically therethrough below said first winding opening and being aligned with said first winding opening, first ferromagnetic enclosure means at least partially enclosing said first solenoid winding and defining a passageway extending vertically therethrough above said first winding opening and being aligned with said first winding opening, a first ferromagnetic armature movable downwardly and upwardly in said first winding opening, said first ferromagnetic armature extending upwardly through said passageway in said first enclosure means, at least one non-magnetic push rod connected to said first armature and extending down through said opening in said first mounting member and being connected to said motion member for thrusting said motion member downward from an initial position upon electrical energization of said first solenoid winding, return means mounted on said first mounting member and being connected to said motion member for returning said motion member upwardly to said initial position following such downward thrusting of said motion member, a second mounting member, a plurality of supports extending downwardly from said second mounting member for supporting said second mounting member in spaced relationship above said first mounting member, a second solenoid winding mounted onto said second mounting member above said second mounting member, said second solenoid winding having a second winding opening extending vertically through said second winding, said second mounting member having an opening extending vertically therethrough below said second winding opening and being aligned with said second winding opening, second ferromagnetic enclosure means at least partially enclosing said second solenoid winding and defining a passageway extending vertically therethrough above said second winding opening and being aligned with said second winding opening, a second ferromagnetic armature movable downwardly and upwardly in said second winding opening, said second ferromagnetic armature extending upwardly through said passageway in said second enclosure means, said second ferromagnetic armature being above said first electromagnetic armature and being aligned therewith, at least one non-magnetic push rod extender connected to said second armature and extending down through said opening in said second mounting member and being connected to said push rod for aiding said first armature in thrusting said motion member downward from said initial position upon electrical energization of said second solenoid winding.

38. The electromagnetically energized thrust motor system claimed in claim 37, further characterized in that:

a pair of non-magnetic push rods are connected to said first armature and extend down through said opening in said first mounting member and are connected to said motion member for thrusting said motion member downwardly upon electrical energization of said first solenoid winding, a pair of non-magnetic push rod extenders are connected to said second armature and extend down through said opening in said second mounting member, and respective ones of said push rod extenders are aligned with respective non-magnetic push rods and are connected to the respective non-magnetic push rods with which they are aligned.

39. The electromagnetically energized thrust motor system claimed in claim 38, further characterized in that:

each of said non-magnetic push rods has a shoulder thereon, said shoulders are positioned at the same distance above said motion member, each of said push rods has a threaded stud extending upwardly above the shoulder, said first armature has a pair of vertical mounting passages therein, a respective threaded stud extends upwardly through a respective mounting passage in the first armature, each of said push rod extenders has a threaded socket in its lower end, and respective ones of the threaded sockets are screwed onto upper ends of said threaded studs for holding said first armature in intermediate relationship between said shoulders and said push rod extenders.

40. The electromagnetically energized thrust motor system claimed in claim 37, wherein:

said first and second solenoid windings are connected in parallel electrical relationship to an electrical power source for providing substantially twice the downward thrust of a single such winding connected alone to such power source.

41. The electromagnetically energized thrust motor system claimed in claim 37, wherein:

said first and second solenoid windings are connected in series electrical relationship to an electrical power source for reducing the heating effect of electrical current to about one-quarter the heating effect resulting from connecting a single such winding alone to the power source, and the resulting downward thrust resulting from said series-connected first and second windings is about the same as for a single such winding connected alone to such power source.

42. An electromagnetic thrust motor for use in operating a die set including a base for mounting base tooling with a plurality of guide pins upstanding from said base and a motion member for mounting upper tooling above said base tooling, said motion member being movable downwardly and upwardly along said guide pins, said electromagnetic thrust motor comprising:

a top mounting member adapted to be attached to said guide pins above said motion member for positioning said top mounting member above said motion member, at least one solenoid winding mounted onto said top mounting member above said top mounting member, said solenoid winding having a winding opening extending vertically through said winding, said top mounting member having an opening extending therethrough below said winding opening and being aligned with said winding opening, ferromagnetic enclosure means at least partially enclosing said solenoid winding and defining a passageway extending therethrough above said winding opening and being aligned with said winding opening, a ferromagnetic armature movable downwardly and upwardly in said winding opening, said ferromagnetic armature extending upwardly through said passageway defined by said enclosure means, at least one non-magnetic push rod connected to said armature and extending down through said opening in said top mounting member and being connected to said motion member for thrusting said motion member downward from an initial position of said motion member upon electrical energization of said solenoid winding, and return means mounted to said top mounting member and being connectable to said motion member for returning said motion member upwardly to said initial position following such downward thrusting of said motion member.

43. The electromagnetic thrust motor claimed in claim 42, further characterized in that:

armature position adjusting means are provided for adjusting the position of the armature relative to said solenoid winding, said armature position adjusting means comprising:

a shoulder on the push rod, a stud on the push rod upstanding above said shoulder, said armature having a mounting passage therein, said stud upstanding through said mounting passage for mounting the armature on said stud above said shoulder, releasable fastening means on said stud for retaining the armature on the stud, a plurality of non-magnetic spacers each having a hole therein, said spacers having various thicknesses, said holes being of sufficient size for allowing said spacers to be mounted on said stud and being sufficiently small for preventing any spacers on the stud from going downward past said shoulder, and said spacers being mounted on said stud along with the armature.

44. The electromagnetic thrust motor claimed in claim 43, in which:

there are at least three spacers, and said spaces have different relative thicknesses.

45. The electromagnetic thrust motor claimed in claim 44, in which:

said spacers have thicknesses of about 0.125 of an inch, about 0.250 of an inch and about 0.375 of an inch.

46. The electromagnetic thrust motor claimed in claim 42, further characterized in that:

said return means comprise:

at least one elongated compression spring, at least one socket in said top mounting member, at least one spring cup mounted in such socket, the spring cup extending down below said top mounting member, the spring cup having a bottom with a central hole in the bottom, at least one spring rod fastened to said motion member and extending up through the hole in the bottom of the spring cup and up through the spring cup and extending up to a top of said rod at a substantial height above said top mounting member, the spring being seated in the spring cup and encircling the spring rod and extending up near the top of the rod, and return-rate adjusting means on the spring rod near the top of the rod pressing down on the spring for causing the spring rod to exert an upward force on the motion member.

47. The electromagnetic thrust motor claimed in claim 46, further characterized in that:

said motion member has a predetermined maximum downward stroke, said compression spring has a length at least about four times said maximum downward stroke, and said spring cut extends down a substantial distance below the top mounting member with the bottom of the spring cup being closer to the motion member in the initial position than to the top mounting member for substantially reducing the elevation of the return-rate adjusting means above the top mounting member.

48. The electromagnetic thrust motor claimed in claim 47, further characterized in that:

there are two such compression springs, there are two such spring cups, and said spring cups are removable from their sockets in said top mounting member.

49. The electromagnetic thrust motor claimed in claim 42, further comprising:

a cooling housing mounted on the top mounting member for housing the solenoid winding, the ferromagnetic enclosure means and the ferromagnetic armature, said cooling housing having an air intake opening and at least one outlet port, and fan means associated with said cooling housing for flowing air through the housing from said intake opening to the outlet port for cooling the solenoid winding, the ferromagnetic enclosure means and the ferromagnetic armature.

50. The electromagnetic thrust motor claimed in claim 49, further characterized in that:

said top mounting member is ferromagnetic, said top mounting member is spaced at least about two inches (at least about 50 mm) above said motion member in the initial position, said top mounting member has a horizontal extent comparable with a horizontal extent of said motion member, said cooling housing also houses said return means and covers substantially all of said top mounting member, said cooling housing has said air intake opening positioned above the armature, and said cooling housing has at least two outlet ports on opposite sides contiguous with said top mounting member for cooling said top mounting member.

51. The electromagnetic thrust motor claimed in claim 50, further characterized in that:

there are two return means on opposite sides of the solenoid winding, there are also stroke length adjusting means on opposite sides of the solenoid winding, and one of said return means is in the front of one of said stroke length adjusting means and the other of said return means is behind the other of said stroke length adjusting means for providing balance to said motion member.

52. The electromagnetic thrust motor claimed in claim 42, further characterized in that:

said top mounting member is ferromagnetic, and said top mounting member is spaced at least about two inches (at least about 50 mm) above said motion member in the initial position for substantially isolating the tooling from magnetization effects due to electrical energization of said solenoid winding.

53. The electromagnetic thrust motor claimed in claim 42, further characterized in that:

there are two return means on opposite sides of the solenoid winding, there are also two stroke length adjusting means on opposite sides of the solenoid winding, and one of said return means is in front of one of said stroke length adjusting means and the other of said return means is behind the other of said stroke length adjusting means for providing balance to said motion member.

* * * * *